US011117763B2

(12) United States Patent
Sugiyama

(10) Patent No.: US 11,117,763 B2
(45) Date of Patent: Sep. 14, 2021

(54) SHEET PROCESSING APPARATUS AND IMAGE FORMING SYSTEM INCORPORATING THE SHEET PROCESSING APPARATUS

(71) Applicant: Keisuke Sugiyama, Kanagawa (JP)

(72) Inventor: Keisuke Sugiyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/986,535

(22) Filed: Aug. 6, 2020

(65) Prior Publication Data

US 2021/0039904 A1 Feb. 11, 2021

(30) Foreign Application Priority Data

Aug. 9, 2019 (JP) ..... JP2019-148129

(51) Int. Cl.

| | |
|---|---|
| ***B29C 53/06*** | (2006.01) |
| ***B65H 5/12*** | (2006.01) |
| ***B65H 35/00*** | (2006.01) |
| ***B65H 37/06*** | (2006.01) |

(52) U.S. Cl.

CPC ..... *B65H 5/12* (2013.01); *B65H 35/0006* (2013.01); *B65H 37/06* (2013.01)

(58) Field of Classification Search

CPC ..... B29C 53/06; B65H 5/12; B65H 37/06; B65H 35/0006; B65H 35/008; B65H 35/0086

USPC ..... 270/58.07

See application file for complete search history.

(56) References Cited

U.S. PATENT DOCUMENTS

| | | | | |
|---|---|---|---|---|
| 6,112,630 | A | 9/2000 | Miura | |
| 6,190,297 | B1 | 2/2001 | Croft | |
| 7,954,797 | B2 * | 6/2011 | Sasahara | G03G 15/6582 270/45 |

(Continued)

FOREIGN PATENT DOCUMENTS

| | | |
|---|---|---|
| EP | 1346937 | 9/2003 |
| JP | 2000-272823 A | 10/2000 |

(Continued)

OTHER PUBLICATIONS

Extended European Search Report dated Feb. 22, 2021.

*Primary Examiner* — Leslie A Nicholson, III
(74) *Attorney, Agent, or Firm* — Harness, Dickey & Pierce, P.L.C.

(57) ABSTRACT

A sheet processing apparatus includes a sheet conveyor, a processing tool, a tool contact separation device, a tool moving device, and a tool facing device. The sheet conveyor is configured to convey a sheet. The processing tool is configured to perform processing to the sheet. The tool contact separation device is configured to contact and separate the processing tool with respect to the sheet. The tool moving device is configured to move the processing tool in a direction intersecting a conveyance direction of the sheet. The tool facing device includes a tool facing portion and a sheet gripper. The tool facing portion includes a rotary member supported by a shaft and is disposed at a position facing the processing tool via the sheet. The sheet gripper includes a rotary member supported by a shaft and is configured to grip the sheet with the tool facing portion.

16 Claims, 18 Drawing Sheets

(56) References Cited

U.S. PATENT DOCUMENTS

| | | | | |
|---|---|---|---|---|
| 8,573,581 | B2 * | 11/2013 | Suzuki | B65H 45/18 270/45 |
| 9,221,648 | B2 * | 12/2015 | Sugiyama | B31F 1/0035 |
| 9,688,503 | B2 * | 6/2017 | Fukasawa | B65H 45/18 |
| 10,377,604 | B2 * | 8/2019 | Awano | B29C 53/06 |
| 2005/0223865 | A1 | 10/2005 | Hennes | |
| 2011/0248440 | A1 | 10/2011 | Sugiyama et al. | |
| 2011/0301011 | A1 | 12/2011 | Ishikawa et al. | |
| 2012/0267846 | A1 | 10/2012 | Nakada et al. | |
| 2012/0282004 | A1 | 11/2012 | Furuhashi et al. | |
| 2013/0134659 | A1 | 5/2013 | Konno et al. | |
| 2013/0147105 | A1 | 6/2013 | Sugiyama et al. | |
| 2013/0228965 | A1 | 9/2013 | Hoshino et al. | |
| 2013/0236228 | A1 | 9/2013 | Nagasako et al. | |
| 2014/0062005 | A1 | 3/2014 | Suzuki et al. | |
| 2014/0062016 | A1 | 3/2014 | Watanabe et al. | |
| 2014/0151949 | A1 | 6/2014 | Hoshino | |
| 2014/0203501 | A1 | 7/2014 | Hoshino et al. | |
| 2015/0253716 | A1 | 9/2015 | Nagasako et al. | |
| 2015/0353315 | A1 | 12/2015 | Suzuki et al. | |
| 2016/0185552 | A1 | 6/2016 | Hoshino et al. | |
| 2017/0260015 | A1 | 9/2017 | Shimazu et al. | |

FOREIGN PATENT DOCUMENTS

| | | | |
|---|---|---|---|
| JP | 2002-346982 | A | 12/2002 |
| JP | 2005-007721 | A | 1/2005 |
| JP | 2011-251816 | A | 12/2011 |
| JP | 2013-220897 | A | 10/2013 |
| JP | 2014-176958 | A | 9/2014 |

* cited by examiner

SHEET PROCESSING APPARATUS AND IMAGE FORMING SYSTEM INCORPORATING THE SHEET PROCESSING APPARATUS

CROSS-REFERENCE TO RELATED APPLICATION

This patent application is based on and claims priority pursuant to 35 U.S.C. § 119(a) to Japanese Patent Application No. 2019-148129, filed on Aug. 9, 2019, in the Japan Patent Office, the entire disclosure of which is hereby incorporated by reference herein.

BACKGROUND

Technical Field

This disclosure relates to a sheet processing apparatus and an image forming system incorporating the sheet processing apparatus.

Background Art

Various types of sheet processing apparatuses are known to perform a cut process and a crease process to a sheet. Such a sheet processing apparatus is used to create the processing patterns of stickers, cards, or box-shaped 3D objects, from a sheet on which an image or design pattern is printed.

It is known there are various types of sheet processing apparatuses. For example, a flatbed type sheet processing apparatus fixes a sheet on a table provided on the apparatus, and causes a cutter tool and a creasing tool, which are processing tools, to selectively contact with pressure to the sheet or separate from the sheet while moving the cutter tool and the creasing tool over the sheet in a two-dimensional area. By so doing, a two-dimensional processing is provided to the sheet along a given trajectory while the sheet is fixed on the surface of the table.

On the other hand, a conveyance type sheet processing apparatus is provided with a pair of sheet conveyance rollers to convey a sheet, in addition to the same processing tools as the processing tools provided in the flatbed type sheet processing apparatus. The conveyance type sheet processing apparatus moves the processing tools in a direction orthogonal to the conveyance direction of the sheet while conveying the sheet.

SUMMARY

At least one aspect of this disclosure, a novel sheet processing apparatus includes a sheet conveyor, a processing tool, a tool contact separation device, a tool moving device, and a tool facing device. The sheet conveyor is configured to convey a sheet. The processing tool is configured to perform processing to the sheet. The tool contact separation device is configured to contact and separate the processing tool with respect to the sheet. The tool moving device is configured to move the processing tool in a direction intersecting a conveyance direction of the sheet. The too facing device includes a tool facing portion and a sheet gripper. The tool facing portion includes a rotary member supported by a shaft and is disposed at a position facing the processing tool via the sheet. The sheet gripper includes a rotary member supported by a shaft and is configured to grip the sheet with the tool facing portion.

Further, at least one aspect of this disclosure, an image forming system includes an image forming apparatus configured to form an image on a sheet and eject the sheet with the image, and the above-described sheet processing apparatus configured to process the sheet with the image formed by the image forming apparatus.

BRIEF DESCRIPTION OF THE SEVERAL VIEWS OF THE DRAWINGS

Exemplary embodiments of this disclosure will be described in detail based on the following figures, wherein.

Figure 1:
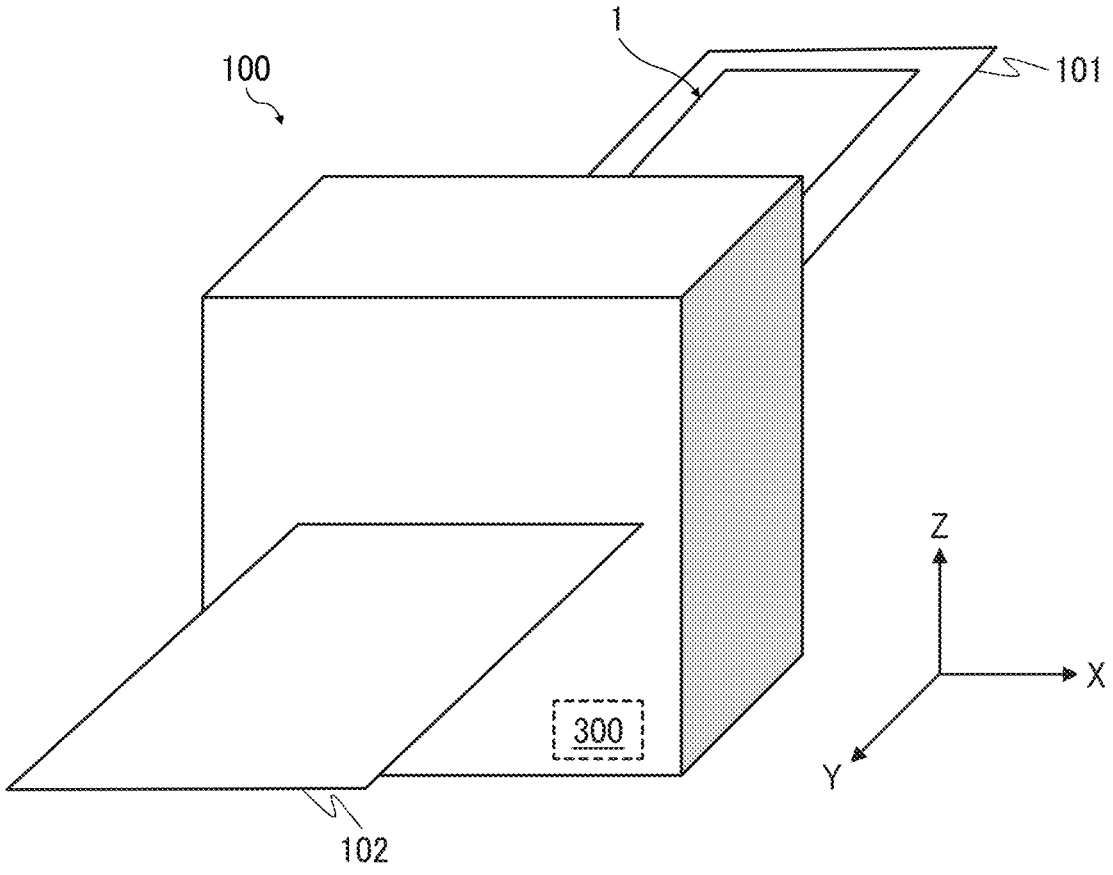
FIG. 1 is a perspective view illustrating a sheet processing apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Overall Configuration of Sheet Processing Apparatus.

Hereinafter, embodiments of a sheet processing apparatus according to the present embodiment is described with reference to the drawings.

FIG. 1 is a perspective view illustrating the external appearance of a sheet processing apparatus 100 according to an embodiment of this disclosure.

As illustrated in FIG. 1, the sheet processing apparatus 100 includes a sheet receiver tray 101 and a sheet transfer tray 102. The sheet receiver tray 101 functions as a sheet receiving port via which a sheet 1 that functions as a sheet-like processing target member (sheet member) is conveyed to the sheet processing apparatus 100. The sheet transfer tray 102 functions as a sheet transfer port of the processed sheet 1 after processing. The sheet 1 is processed while being conveyed in a direction indicated by arrow Y (Y direction) in FIG. 1.

Note that, as illustrated in FIG. 1, the sheet processing apparatus 100 further includes a control device 300 that controls the whole operations of the sheet processing apparatus 100.

Here, coordinate systems used to describe the present embodiment are defined.

A Y direction is a direction in which the sheet 1 before processing is conveyed to the sheet processing apparatus 100 and the sheet 1 after processing is conveyed from the sheet processing apparatus 100. An X direction is a direction that intersects the Y direction and corresponds to the width direction of the sheet 1 (the width direction of the sheet processing apparatus 100). A Z direction is a direction that intersects the Y direction and the X direction and corresponds to the direction of height of the sheet processing apparatus 100.

Note that the embodiment is explained with an example in which the X direction, the Y direction, and the Z direction are orthogonal to each other. Accordingly, the phrase "conveyance direction of the sheet 1" in the present embodiment corresponds to movement of the sheet 1 in the Y direction.

Figure 2:
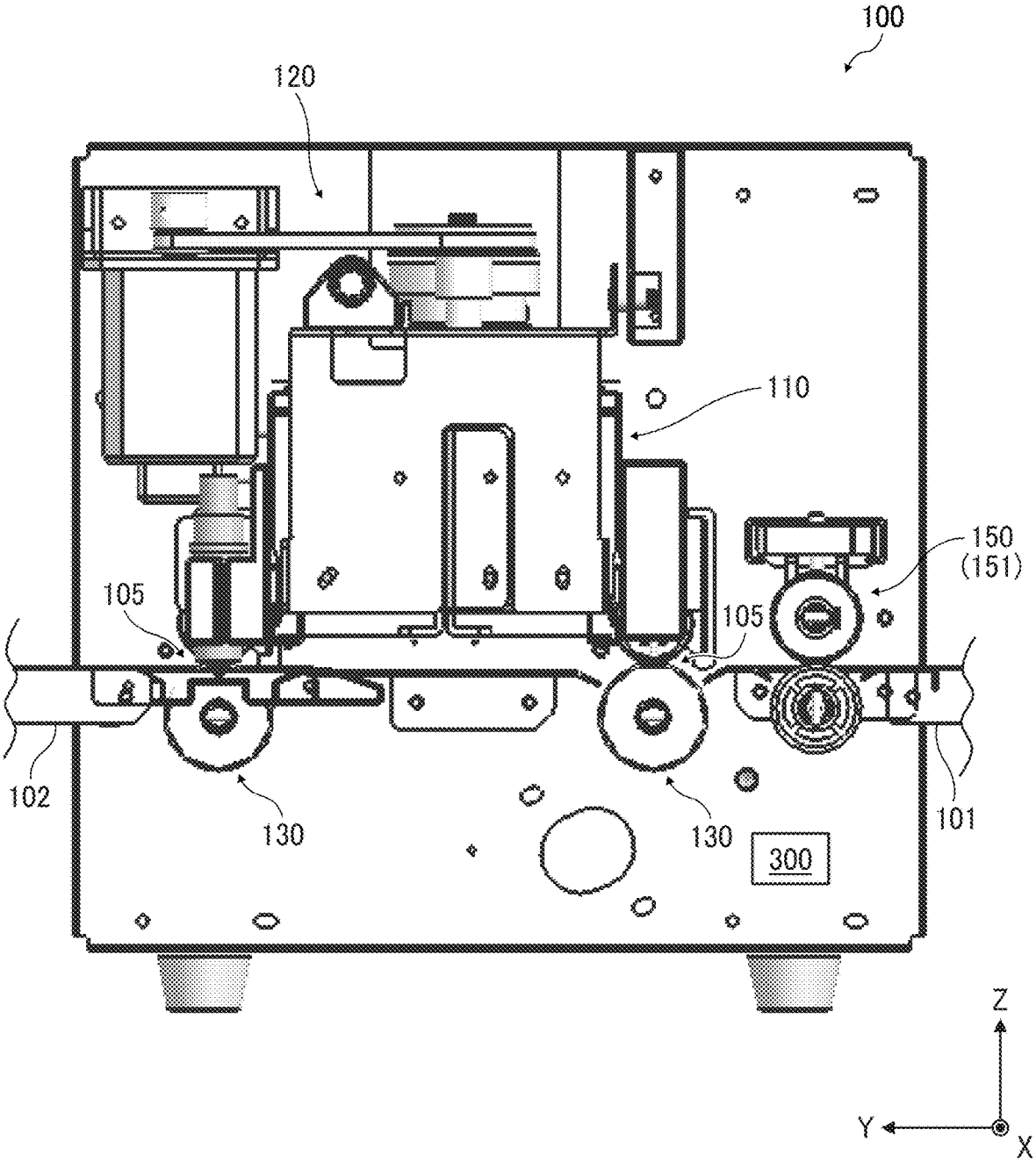
FIG. 2 is a cross-sectional view illustrating the sheet processing apparatus.

FIG. 2 is a cross-sectional view illustrating the internal configuration of the sheet processing apparatus 100. FIG. 2 is the cross-sectional view parallel to a plane Y-Z of the sheet processing apparatus 100 in FIG. 1 and the cross-sectional view from the +X direction toward the −X direction.

As illustrated in FIG. 2, the sheet processing apparatus 100 includes processing tools 105, a tool contact separation device 110, a tool moving device 120, and a tool facing device 130. The sheet processing apparatus 100 further includes pairs of sheet conveyance rollers 150 that function as conveyance members to reciprocally convey the sheet 1 toward the processing tools 105. The pairs of sheet conveyance rollers 150 include a first pair of sheet conveyance rollers 151 and a second pair of sheet conveyance rollers 152. In FIG. 2, the first pair of sheet conveyance rollers 151 alone is depicted from the pairs of sheet conveyance rollers 150. The first pair of sheet conveyance rollers 151 is disposed on the sheet receiving port side.

The processing tools 105 are held by the tool contact separation device 110 so that the processing tools 105 are disposed at respective positions facing the tool facing device 130 via the sheet 1.

The tool contact separation device 110 holds the processing tools 105 such as a cutter tool to perform a cut process to the sheet 1 and a creasing tool to perform a crease process to the sheet 1. Details of the processing tools 105 are described below. The tool contact separation device 110 includes a tool moving mechanism for contact and separation of the processing tools to cause the processing tools 105 to contact to or separate from the sheet 1.

The tool moving device 120 includes a tool moving mechanism for sheet processing (the tool moving mechanism for contact and separation of the processing tools) to move the processing tools 105 and the tool contact separation device 110 in the X direction when the sheet processing such as the cut process and the crease process is performed to the sheet 1. In other words, the tool moving device 120 includes a tool driving mechanism. That is, the cutter tool 111 and the creasing tool 112 move in the X direction with respect to the sheet 1 (see FIG. 3).

However, the configuration of the sheet processing apparatus 100 is not limited to the above-described configuration. For example, the tool moving device 120 may include the tool moving mechanism for sheet processing that moves the processing took 105 in the X direction and the tool contact separation device 110 may include the tool moving mechanism for contact and separation of the processing tools (a tool moving device moving mechanism for contact and separation of the processing tools) to cause the processing tools 105 to contact or separate from the tool moving device 120. Alternatively, a mechanism may move the processing tools 105 alone in the width direction of the sheet 1 and another mechanism may move the processing tools 105 alone to contact to and separate from the sheet 1.

The tool facing device 130 includes rollers that function as rotary members. The rollers include respective tool opposing faces disposed facing the processing tools 105. Each opposing face corresponds to a position to receive pressing force by which the processing tools 105 press the sheet 1 according to a process position at which the processing tool 105 contacts the sheet 1 when the processing tool 105 moves in the X direction in the sheet processing. In other words, the tool opposing face is located at a position at which the tool opposing face of the tool facing device 130 faces the processing tool 105 via the sheet 1 interposed between the tool facing device 130 and the processing tool 105. As illustrated in FIG. 2, the tool opposing face of the tool facing device 130 corresponds to the same position as the processing tool 105 in the Y direction. In other words, the tool opposing face of the tool facing device 130 is disposed below the processing tool 105 in the vertical direction (the Z direction). Further, in other words, the processing tool 105 is disposed above the opposing face in the vertical direction (the Z direction) and is held not to move (that is, held to be immovable) in the Y direction.

The sheet processing apparatus 100 performs the sheet processing by the processing tools 105 while the sheet 1 is conveyed in the Y direction. In the sheet processing, the tool contact separation device 110 moves not in the Y direction to the tool facing device 130 but in the X direction to the tool facing device 130. When the sheet processing is performed to the sheet 1, the processing tools 105 selectively contact to or separate from the sheet 1 while the tool contact separation device 110 moves in the X direction. With the above-described operation, the processing tools 105 (that is, the creasing tool 112 and the cutter tool 111) move relative to the sheet 1 while drawing a trajectory including given plane free curves on the sheet 1. That is, the sheet processing apparatus 100 performs sheet processing while drawing a trajectory including given plane free curves on the sheet 1.

Configuration of Main Part of the Sheet Processing Apparatus 100.

Figure 3:
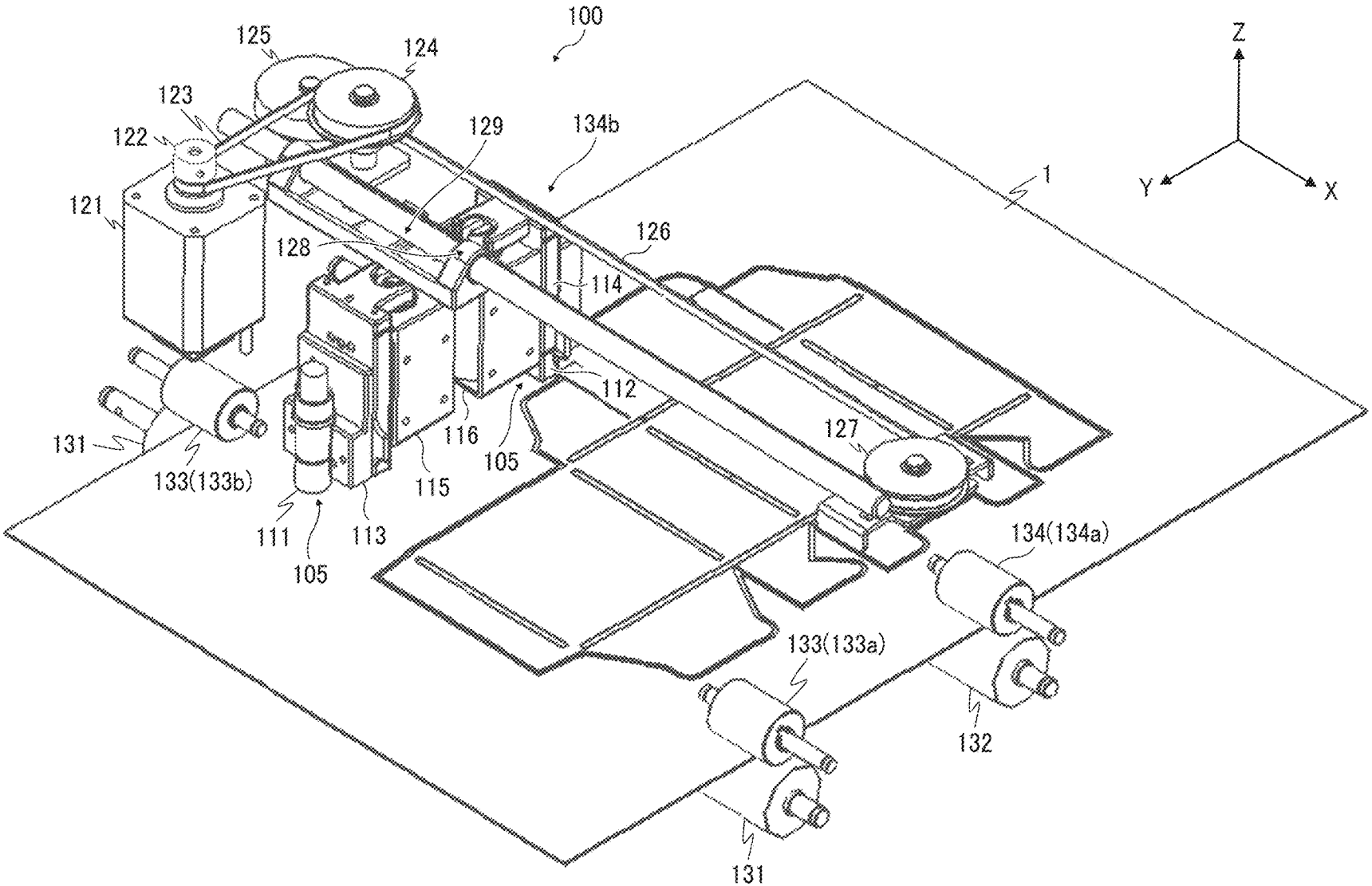
FIG. 3 is a perspective view illustrating a main part of the sheet processing apparatus.
Figure 4:
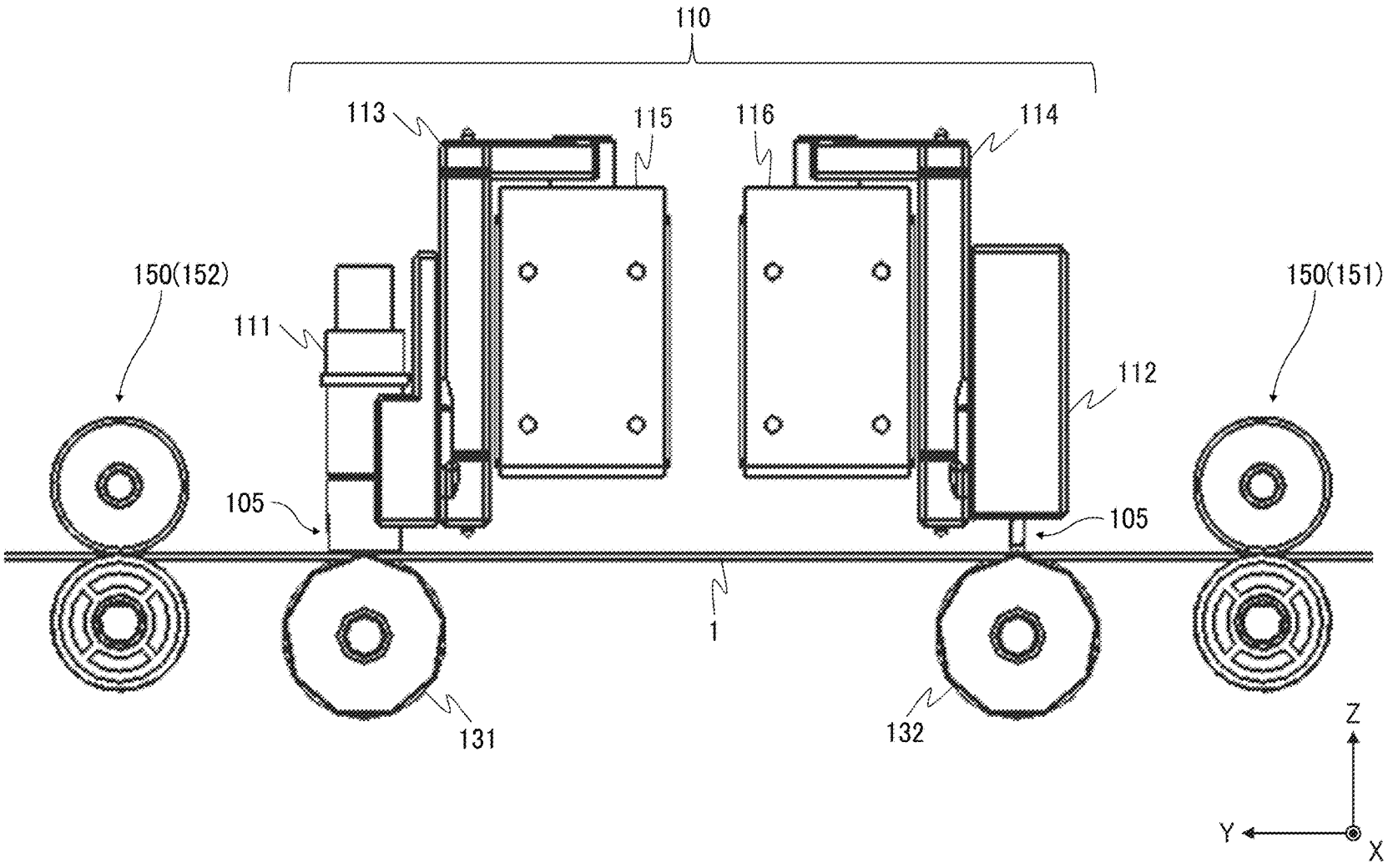
FIG. 4 is an enlarged side view illustrating a part of the main part of the sheet processing apparatus.
Figure 5:
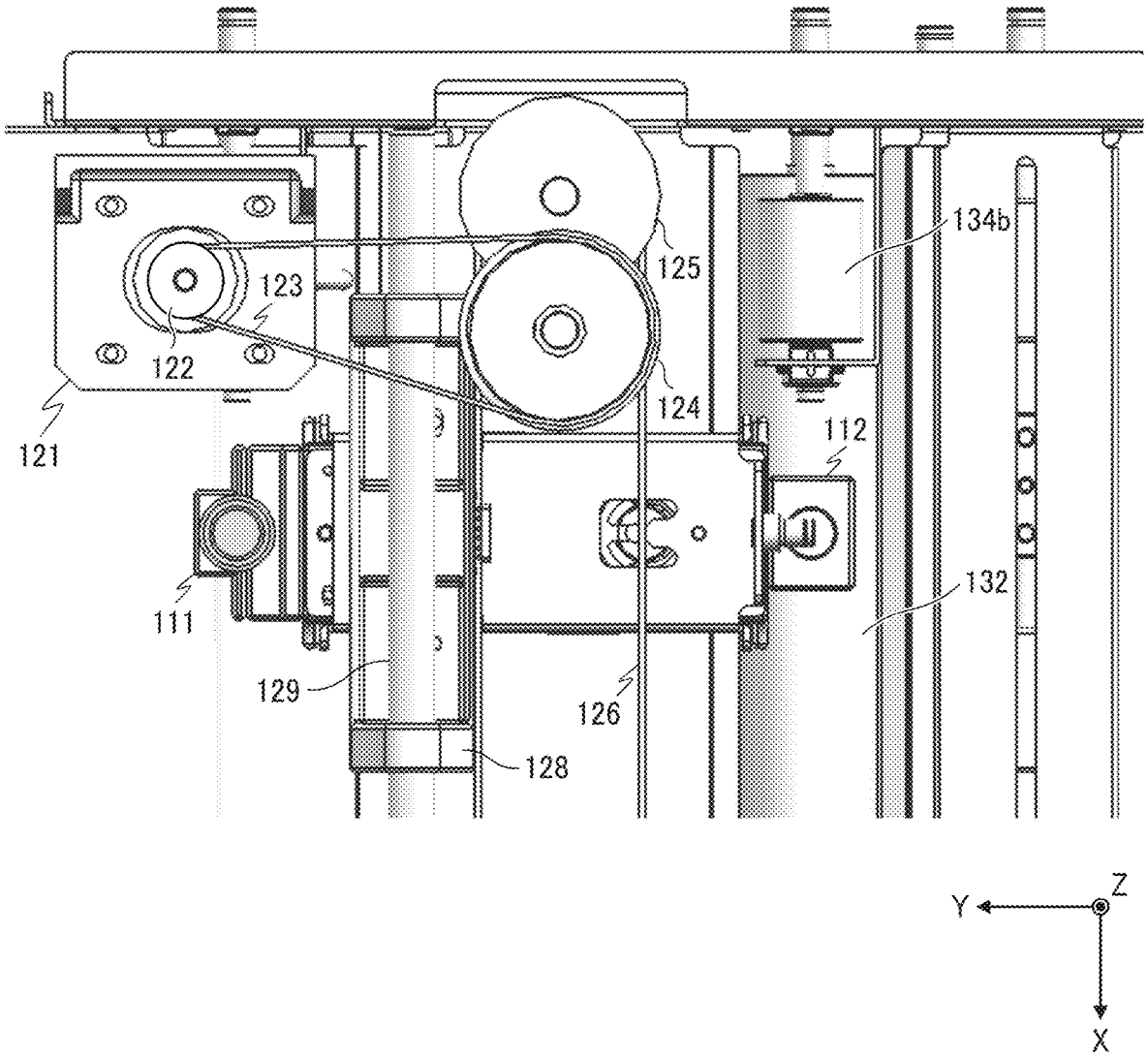
FIG. 5 is an enlarged plan view illustrating a part of the main part of the sheet processing apparatus.
Figure 6:
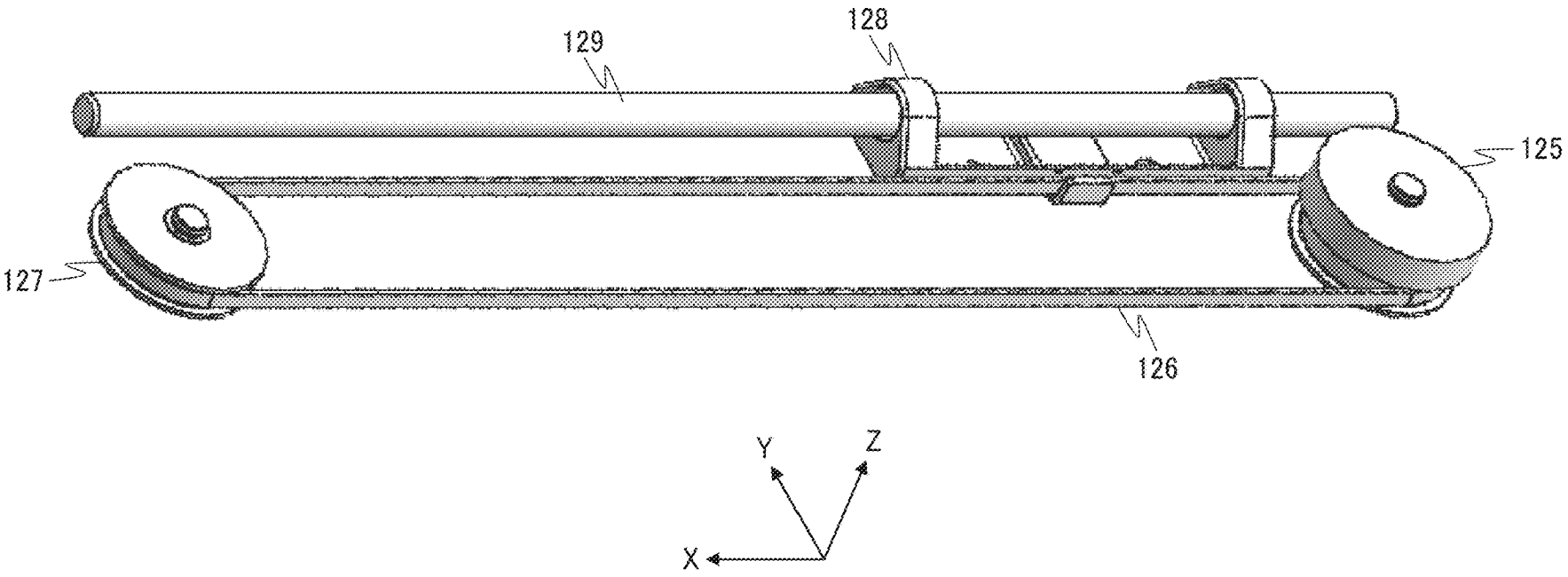
FIG. 6 is an enlarged perspective view illustrating a part of the main part of the sheet processing apparatus.

FIG. 3 is a perspective view illustrating the main part of the internal configuration of the sheet processing apparatus 100. FIG. 4 is an enlarged side view illustrating the tool contact separation device 110 provided in the internal configuration of the sheet processing apparatus 100. FIG. 5 is an enlarged plan view illustrating a drive source of the tool moving device 120 of the sheet processing apparatus 100. FIG. 6 is an enlarged perspective view illustrating a movable holding mechanism of the tool moving device 120 of the sheet processing apparatus 100. Note that the pairs of sheet conveyance rollers 150 are not depicted in FIG. 3.

Configuration of Tool Contact Separation Device 110.

First, a description is given of the configuration of the tool contact separation device 110 with reference to FIGS. 3 and 4.

The tool contact separation device 110 includes a cutter tool 111, a creasing tool 112, a first tool holder 113, a second tool holder 114, a first contact separation actuator 115, and a second contact separation actuator 116. The cutter tool 111 and the creasing tool 112 are included in the processing tools 105.

The cutter tool 111 that functions as a first processing tool is a cutter that contacts the sheet 1 to perform the cut process to the sheet 1. The creasing tool 112 that functions as a second processing tool is a creaser that presses the sheet 1 to perform the crease process to the sheet 1, in other words, to make a crease line or lines in the surface of the sheet 1. The cutter tool 111 is retained above a first facing roller 131 in the vertical direction. The cutter tool 111 that functions as a tool facing body is disposed facing the first facing roller 131. The creasing tool 112 is retained above a second facing roller 132 in the vertical direction. The creasing tool 112 that functions as a tool facing body is disposed facing the second facing roller 132.

The first tool holder 113 couples and retains the first contact separation actuator 115 and the cutter tool 111. The second tool holder 114 couples and retains the second contact separation actuator 116 and the creasing tool 112.

The first contact separation actuator 115 and the second contact separation actuator 116 are coupled with each other by a tool moving member 128. Details of the tool moving member 128 are described below. The tool moving member 128 causes the tool contact separation device 110 to retain the two processing tools 105 (that is, the cutter tool 111 and the creasing tool 112) integrally to be movable in the X direction. The first contact separation actuator 115 and the second contact separation actuator 116 are solenoids. By supplying the power to the first contact separation actuator 115 and the second contact separation actuator 116, the processing tools 105 maintain in a pressing state in which the first facing roller 131 and the second facing roller 132 press the sheet 1. The control of the operations of the first contact separation actuator 115 and the second contact separation actuator 116 depends on the control program executed in the control device 300 described below. By performing the control, the control device 300 causes the cutter tool 111 and the creasing tool 112 to perform the contact and separation operations to selectively contact or separate from the sheet 1. This contact and separation control controls the processing operation to the sheet 1.

As illustrated in FIG. 4, a first pair of sheet conveyance rollers 151 that functions as a conveyance body is disposed upstream from the tool contact separation device 110 that retains the processing tools 105, in the Y direction (i.e., the conveyance direction of the sheet 1). In addition, a second pair of sheet conveyance rollers 152 that functions as a conveyance body is disposed downstream from the tool contact separation device 110 that retains the processing tools 105, in the Y direction (i.e., the conveyance direction of the sheet 1). The sheet 1 is conveyed in the Y direction by the pairs of sheet conveyance rollers 150 (including the first pair of sheet conveyance rollers 151 and the second pair of sheet conveyance rollers 152). After having been conveyed from the upstream side in the Y direction to the sheet processing apparatus 100, the sheet 1 is held by the first pair of sheet conveyance rollers 151. Due to rotation of the first pair of sheet conveyance rollers 151, the sheet 1 is conveyed under the processing tools 105 to be processed. Then, after the sheet processing is performed to the sheet 1, the sheet 1 is held by the second pair of sheet conveyance rollers 152 to be conveyed out from the sheet processing apparatus 100.

Configuration of Tool Moving Device 120.

Next, a description is given of the configuration of the tool moving device 120, with reference to FIGS. 3, 5, and 6.

The tool moving device 120 includes an X-axis drive motor 121, an X-axis output timing pulley 122, a first X-axis timing belt 123, an X-axis reduction timing pulley 124, a first tool moving pulley 125, a second X-axis timing belt 126, a second tool moving pulley 127, the tool moving member 128, and a tool moving guide shaft 129.

The X-axis drive motor 121 is a drive source that is rotatable in both the forward direction and the reverse direction to move the tool contact separation device 110 that retains the cutter tool 111 and the creasing tool 112, in a direction intersecting the conveyance direction of the sheet 1 (the Y direction). The rotary shaft of the X-axis drive motor 121 is coupled with the X-axis reduction timing pulley 124 from the X-axis output timing pulley 122 via the first X-axis timing belt 123.

The X-axis reduction timing pulley 124 is in contact with the first tool moving pulley 125 via a gear portion that is molded as a single component with the X-axis reduction timing pulley 124. Accordingly, as the X-axis drive motor 121 drives to rotate the X-axis reduction timing pulley 124, the first tool moving pulley 125 rotates via the gear portion.

As illustrated in FIGS. 5 and 6, the first tool moving pulley 125 and the second tool moving pulley 127 as a pair together are coupled by the second X-axis timing belt 126. Accordingly, the second X-axis timing belt 126 that is wound around the first tool moving pulley 125 and the second tool moving pulley 127 rotates along with rotation of the first tool moving pulley 125.

The tool moving member 128 holds the second X-axis timing belt 126 to fix at a given position of the second X-axis timing belt 126. Accordingly, as the second X-axis timing belt 126 rotates between the first tool moving pulley 125 and the second tool moving pulley 127, the tool moving member 128 also moves according to the direction of rotation of the second X-axis timing belt 126. The tool moving guide shaft 129 is inserted through the tool moving member 128. The tool moving guide shaft 129 is disposed extending in the X direction. Both end portions of the tool moving guide shaft 129 are fixed to a housing of the sheet processing apparatus 100. Therefore, along with rotation of the second X-axis timing belt 126, that is, along with rotation of the X-axis drive motor 121, the tool moving member 128 is guided by the tool moving guide shaft 129 to move in the X direction alone. Consequently, as the X-axis drive motor 121 rotates in the forward direction and the reverse direction, the tool contact separation device 110 that is coupled with and fixed to the tool moving member 128 reciprocally moves in the direction (the X-axis direction) intersecting the conveyance direction of the sheet 1. Accordingly, the processing tools 105 are held to be reciprocally movable in the direction (the X-axis direction) intersecting the conveyance direction of the sheet 1.

Configuration of Tool Facing Device 130.

Next, a description is given of the configuration of the tool facing device 130, with reference to FIG. 3.

The tool facing device 130 includes the first facing roller 131, the second facing roller 132, first gripping rollers 133 (that is, a first gripping roller 133*a* and a first gripping roller 133*b*), and second gripping rollers 134 (that is, a second gripping roller 134*a* and a second gripping roller 134*b*). Each of the first facing roller 131 and the second facing roller 132 functions as a tool facing portion. Each of the first gripping rollers 133 and the second gripping rollers 134 functions as a sheet gripper.

A known conveyance type sheet processing apparatus causes the processing tool to selectively contact the sheet with pressure or separate from the sheet while relatively moving the sheet and the processing tool. By so doing, the processing tool performs the processing along a given trajectory of the processing tool to the sheet.

In the known sheet processing apparatus, a sheet is gripped at a position away from the processing tool in the conveyance direction of the sheet, which is likely to cause a part of the sheet to rise when the cut process or the crease process is performed. If the sheet is lifted up when sheet processing is performed to the sheet, the contact state of the processing tool to the sheet is not appropriate to the sheet processing, and therefore it is difficult to achieve an optimum sheet processing. In other words, the known sheet processing apparatus may cause a problem in which the position of the sheet is not maintained while the sheet processing is performed, resulting in deterioration of the processing accuracy.

Each of the first facing roller 131 and the second facing roller 132 is a rotary member. The first facing roller 131 and the second facing roller 132 are supported by respective rotary shafts to rotate about the respective rotary shafts in both directions, which are the forward direction and the reverse direction, by a drive source such as an electric motor. The first facing roller 131 and the second facing roller 132 rotate (move) to convey the sheet 1 in synchrony with conveyance of the sheet 1 by the first pair of sheet conveyance rollers 151 and the second pair of sheet conveyance rollers 152. The first facing roller 131 and the second facing roller 132 also function as tool facing members having tool facing portions (positions) disposed facing the processing tools 105. The first facing roller 131 and the second facing roller 132 are also drive rollers. The first facing roller 131 includes a first facing portion disposed downstream from the tool contact separation device 110 in the Y direction (i.e., the conveyance direction of the sheet 1). Further, the second facing roller 132 includes a second facing portion disposed upstream from the first facing roller 131 and the tool contact separation device 110 in the Y direction (i.e., the conveyance direction of the sheet 1).

Each of the first gripping rollers 133 (that is, the first gripping roller 133*a* and the first gripping roller 133*b*) is a driven roller that functions as a rotary member. The first gripping rollers are supported by respective rotary shafts and disposed facing the first facing roller 131 that is a drive roller to the first gripping rollers 133. The first gripping rollers 133 (that is, the first gripping roller 133*a* and the first gripping roller 133*b*) are rotated about the respective rotary shafts along with rotation of the first facing roller 131. Similarly, each of the second gripping rollers 134 (that is, the second gripping roller 134*a* and the second gripping roller 134*b*) is a driven roller that functions as a rotary member. The second gripping rollers 134 are supported by respective rotary shafts and disposed facing the second facing roller 132 that is a drive roller to the second gripping rollers 134. The second gripping rollers 134 (that is, the second gripping roller 134*a* and the second gripping roller 134*b*) are rotated about the respective rotary shafts along with rotation of the second facing roller 132. The first gripping rollers 133 are disposed facing the first facing roller 131. The second gripping rollers 134 are disposed facing the second facing roller 132. The sheet 1 is gripped by the first facing roller 131 and the first gripping rollers 133 and by the second facing roller 132 and the second gripping rollers 134, so that the sheet 1 is reciprocally moved (conveyed) in the Y direction. That is, when the sheet processing is performed to the sheet 1, the sheet 1 is conveyed by the first facing roller 131 and the first gripping rollers 133 and by the second facing roller 132 and the second gripping rollers 134, in addition to, by the first pair of sheet conveyance rollers 151 and by the second pair of sheet conveyance rollers 152.

Each of the first gripping rollers 133 includes a first gripping member that is disposed facing the first facing roller 131 that functions as a first facing portion and that grips the sheet 1 together with the first facing roller 131. Similarly, each of the second gripping rollers 134 includes a second gripping member that is disposed facing the second facing roller 132 that functions as a second facing portion and that grips the sheet 1 together with the second facing roller 132.

Each of the first gripping rollers 133 is pressed (biased) by a biasing member in the −Z direction so as to be pressed against the first facing roller 131. Each of the second gripping rollers 134 is pressed (biased) by a biasing member in the −Z direction so as to be pressed against the second facing roller 132. Therefore, the first facing roller 131 and the first gripping rollers 133 (that is, the first gripping roller 133*a* and the first gripping roller 133*b*) grip the sheet 1 while the sheet 1 is being processed. Further, the second facing roller 132 and the second gripping rollers 134 (that is, the second gripping roller 134*a* and the second gripping roller 134*b*) also grip the sheet 1 while the sheet 1 is being processed. Note that, in FIG. 3, a part of the second gripping rollers 134 (that is, the second gripping roller 134*b*) is hidden behind the tool contact separation device 110, and therefore the second gripping roller 134*b* is not depicted in FIG. 3 (see FIG. 7).

When processing the sheet 1, as the first facing roller 131 and the second facing roller 132, both of which function as drive rollers, rotate in the forward and reverse rotations, the sheet 1 in the processing is reciprocally moved (conveyed) in the Y direction. That is, the tool facing device 130 includes a conveying device that functions as a sheet conveyor that reciprocally moves (conveys) the sheet 1 in the Y direction. Due to the control of rotation of the tool facing device 130, the sheet 1 is reciprocally moved between the cutter tool 111 and the first facing roller 131 and between the creasing tool 112 and the second facing roller 132.

The first facing roller 131 that includes a tool opposing face (tool facing portion) to face the cutter tool 111 and the second facing roller 132 that includes the tool opposing face (tool facing portion) to face the creasing tool 112 are rollers, each of which including an elastic body represented by silicon rubber and ethylene propylene (EP) rubber. That is, the tool opposing face of the first facing roller 131 and the tool opposing face of the second facing roller 132 are made of elastic bodies.

In the present embodiment, the pairs of sheet conveyance rollers 150, various rotary members, and the X-axis drive motor 121 are based on stepping motors. However, as long as the above-described operations are performed, the type of a drive source is not limited.

Further, the first contact separation actuator 115 and the second contact separation actuator 116 are based on respective solenoids. However, as long as the above-described operations are performed, the type of a drive source is not limited.

Detailed Description of Tool Facing Device 130.

Next, a detailed description is given of the configuration of the tool facing device 130.

Figure 7:
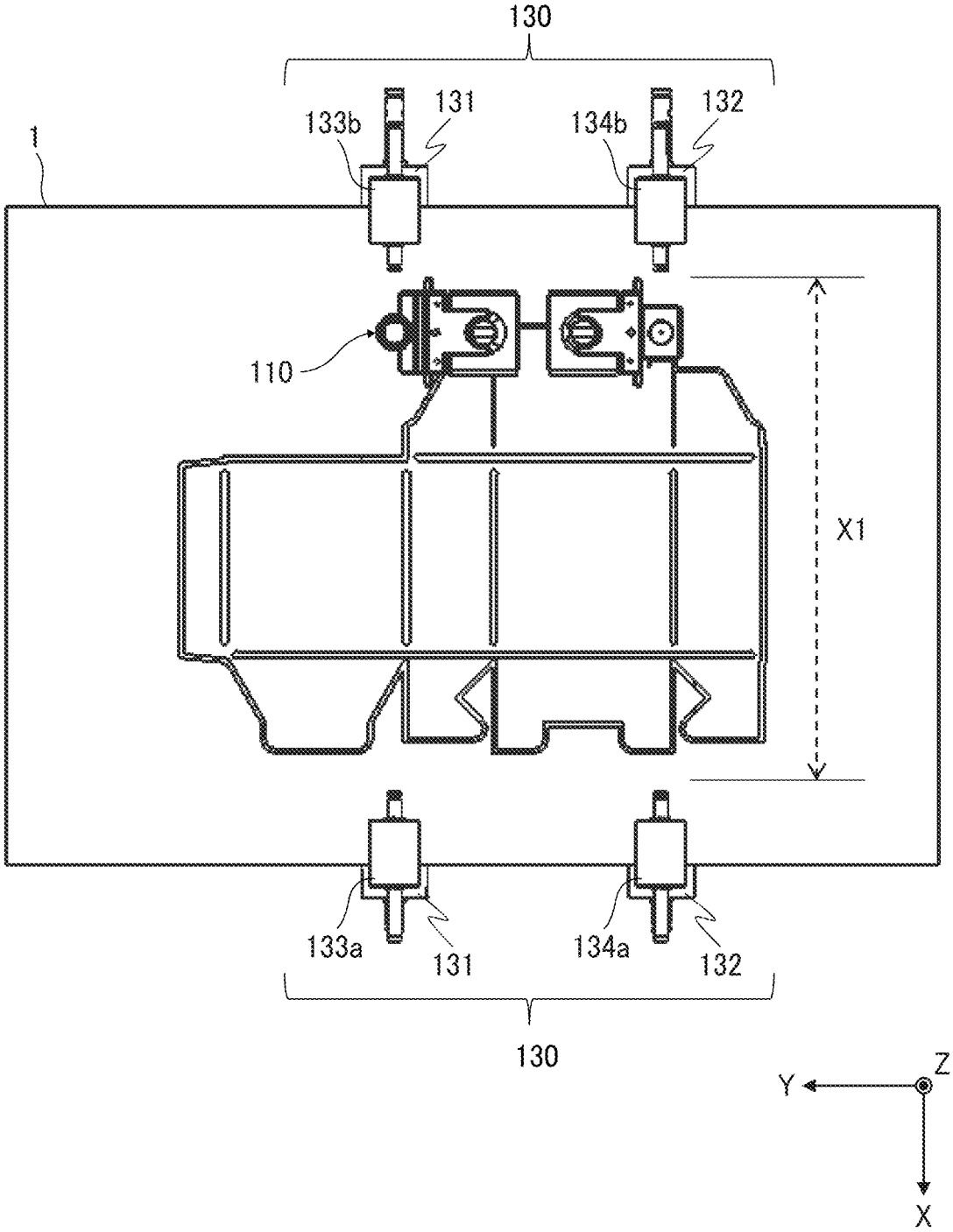
FIG. 7 is a plan view illustrating a part of the main part of the sheet processing apparatus.

FIG. 7 is a plan view illustrating the tool facing device 130 and the tool contact separation device 110, viewed from the Z direction.

As illustrated in FIG. 7, the first gripping rollers 133 (i.e., the first gripping roller 133*a* and the first gripping roller 133*b*), which form pairs with the first facing roller 131 separately, are disposed on the downstream side in the conveyance direction of the sheet 1 (the Y direction) across the tool contact separation device 110. In addition, the tool contact separation device 110 is disposed so that a portion of the tool contact separation device 110 faces the tool facing device 130 between the first facing roller 131 and the second facing roller 132. Further, as illustrated in FIG. 2, the tool moving device 120 is also disposed so that the most part of the tool moving device 120 faces the tool facing device 130 between the first facing roller 131 and the second facing roller 132.

A moving range X1 of the tool contact separation device 110 is indicated by a broken line with arrows in FIG. 7. The tool contact separation device 110 moves in the moving range X1 with respect to the width of the sheet 1. That is, the moving range X1 indicated by the broken line with arrows in FIG. 7 corresponds to an available processing region of the sheet 1. Therefore, the first gripping rollers 133 (i.e., the first gripping rollers 133*a* and 133*b*) and the second gripping rollers 134 (i.e., the second gripping rollers 134*a* and 134*b*) are disposed out of the processing region in which the processing tools 105 perform sheet processing to the sheet 1.

The first gripping rollers 133 and the second gripping rollers 134 are disposed on the extension lines of the cutter tool 111 and the creasing tool 112 in the directions of movement of the cutter tool 111 and the creasing tool 112. Accordingly, the grip positions at which the first facing roller 131 and the first gripping rollers 133 grip the sheet 1 are on the extension line of the cutter tool 111 in the X direction, where the cutter tool 111 performs the cut process to the sheet 1. Similarly, the grip positions at which the second facing roller 132 and the second gripping rollers 134 grip the sheet 1 are on the extension line of the creasing tool 112 in the X direction, where the creasing tool 112 performs the crease process to the sheet 1.

Further, the length of the first facing roller 131 and the length of the second facing roller 132 are longer than the width of the sheet 1 to be processed and the first gripping rollers 133 and the second gripping rollers 134 are disposed at respective positions where the first gripping rollers 133 and the second gripping rollers 134 grip respective end portions (edges) of the sheet 1. In other words, each of the first gripping rollers 133 and the second gripping rollers 134 grips the sheet 1 at a position closer to the corresponding edge of the sheet 1 than the position at which each of the first facing roller 131 and the length of the second facing roller 132 faces the corresponding processing tool 105. The grip range of the first facing roller 131 and the first gripping rollers 133 and the grip range of the second facing roller 132 and the second gripping rollers 134 include the inner side and the outer side of the side end portions of the sheet 1. In other words, the first facing roller 131, the second facing roller 132, the first gripping rollers 133, and the second gripping rollers 134 lie across the border of the side end portions of the sheet 1. That is, the tool facing device 130 grips the sheet 1 across each side end portion of the sheet 1. By gripping the sheet 1 as described above, the positional deviation of the sheet 1 in conveyance of the sheet 1 is restrained.

As described above, the sheet processing apparatus 100 according to the present embodiment grips the sheet 1 at the same positions as the process positions in the conveyance direction of the sheet 1 (that is, the positions where the first facing roller 131 and the second facing roller 132 are disposed). Further, the sheet processing apparatus 100 according to the present embodiment grips the sheet 1 across the side end portions (edges) of the sheet 1. According to this configuration, the sheet processing apparatus 100 according to the present embodiment maintains the position of the sheet 1 at the process positions reliably, and therefore "sag" and "deviation" of the sheet 1, which may cause to the sheet 1 when sheet processing is performed to the sheet 1, are prevented. Accordingly, the preferable processing accuracy is achieved.

Configuration of Drive System of Tool Facing Device 130.

Next, a description is given of the configuration of the drive system included in the tool facing device 130, with reference to FIGS. 8 to 13.

Figure 8:
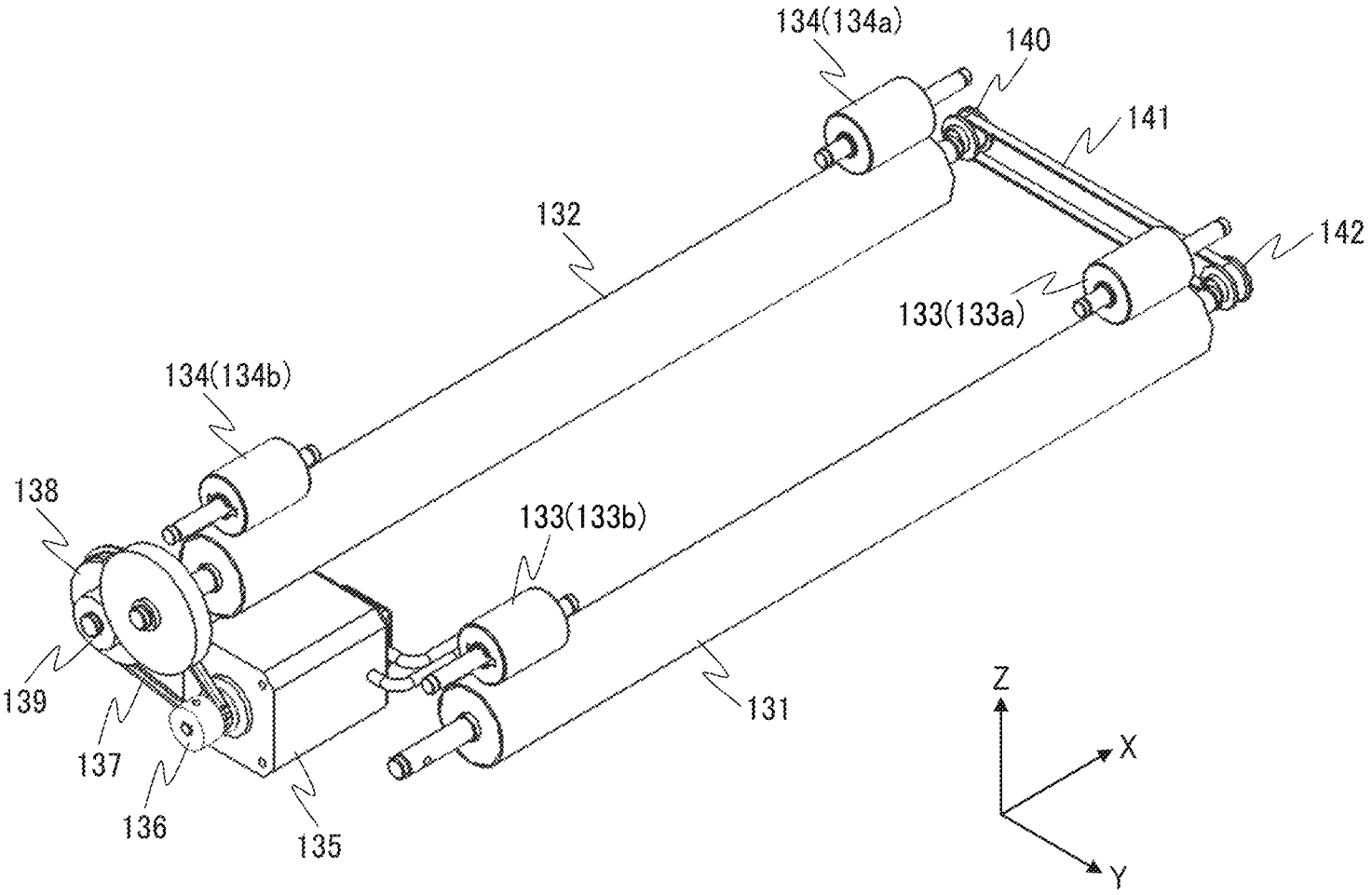
FIG. 8 is a perspective view illustrating a part of the main part of the sheet processing apparatus.
Figure 9:
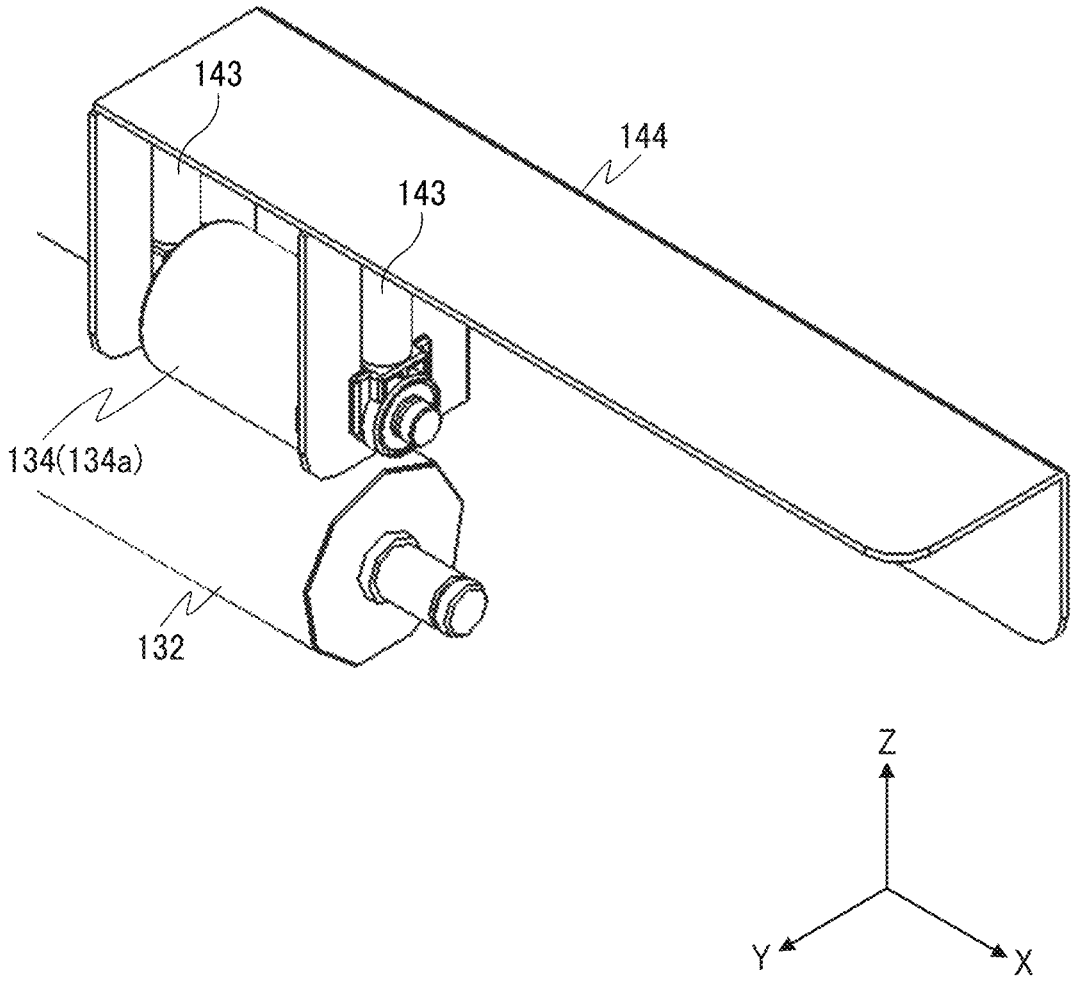
FIG. 9 is an enlarged perspective view illustrating a part of main part of the sheet processing apparatus.
Figure 10:
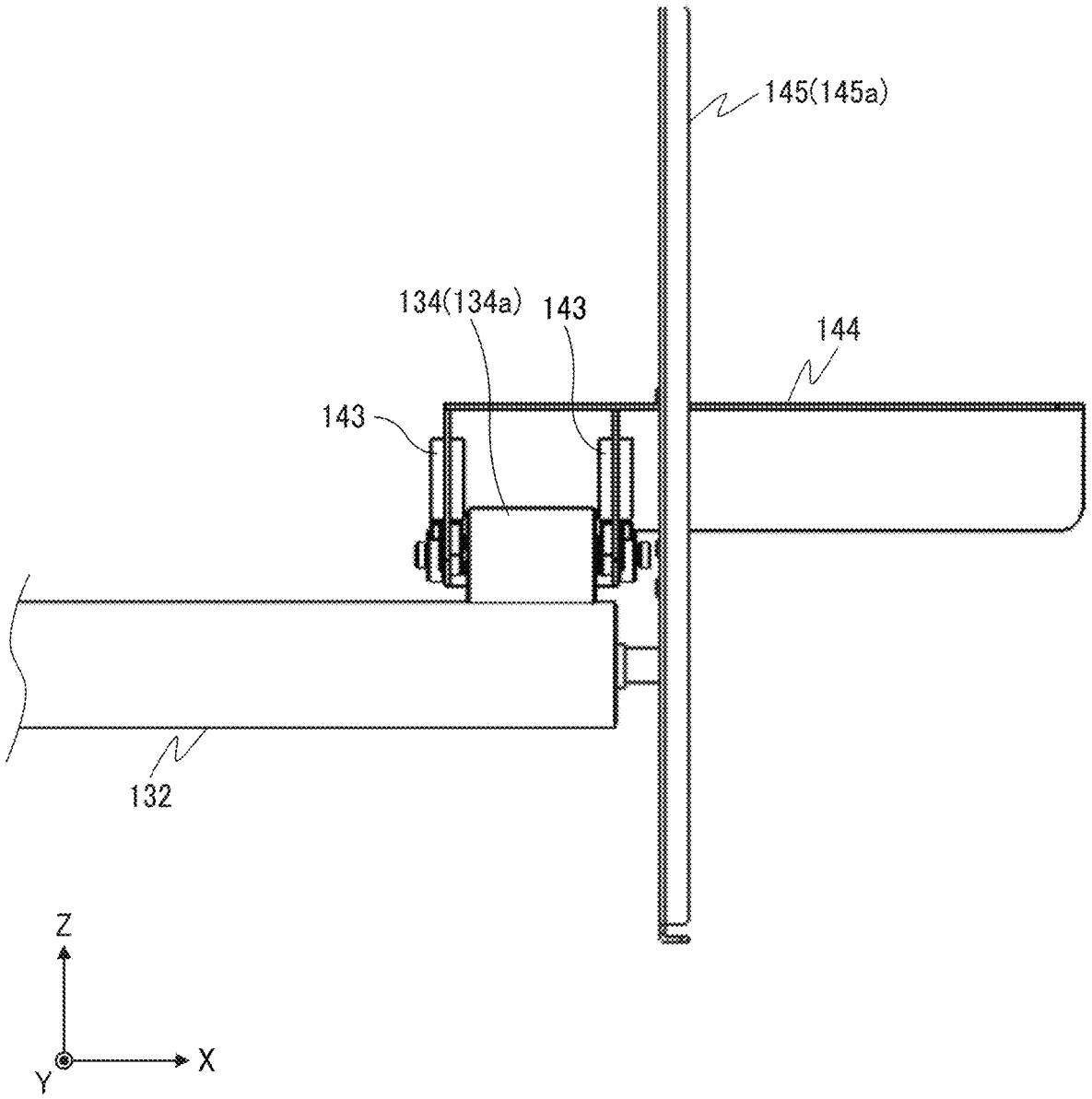
FIG. 10 is a side view illustrating a part of the main part of the sheet processing apparatus.
Figure 11:
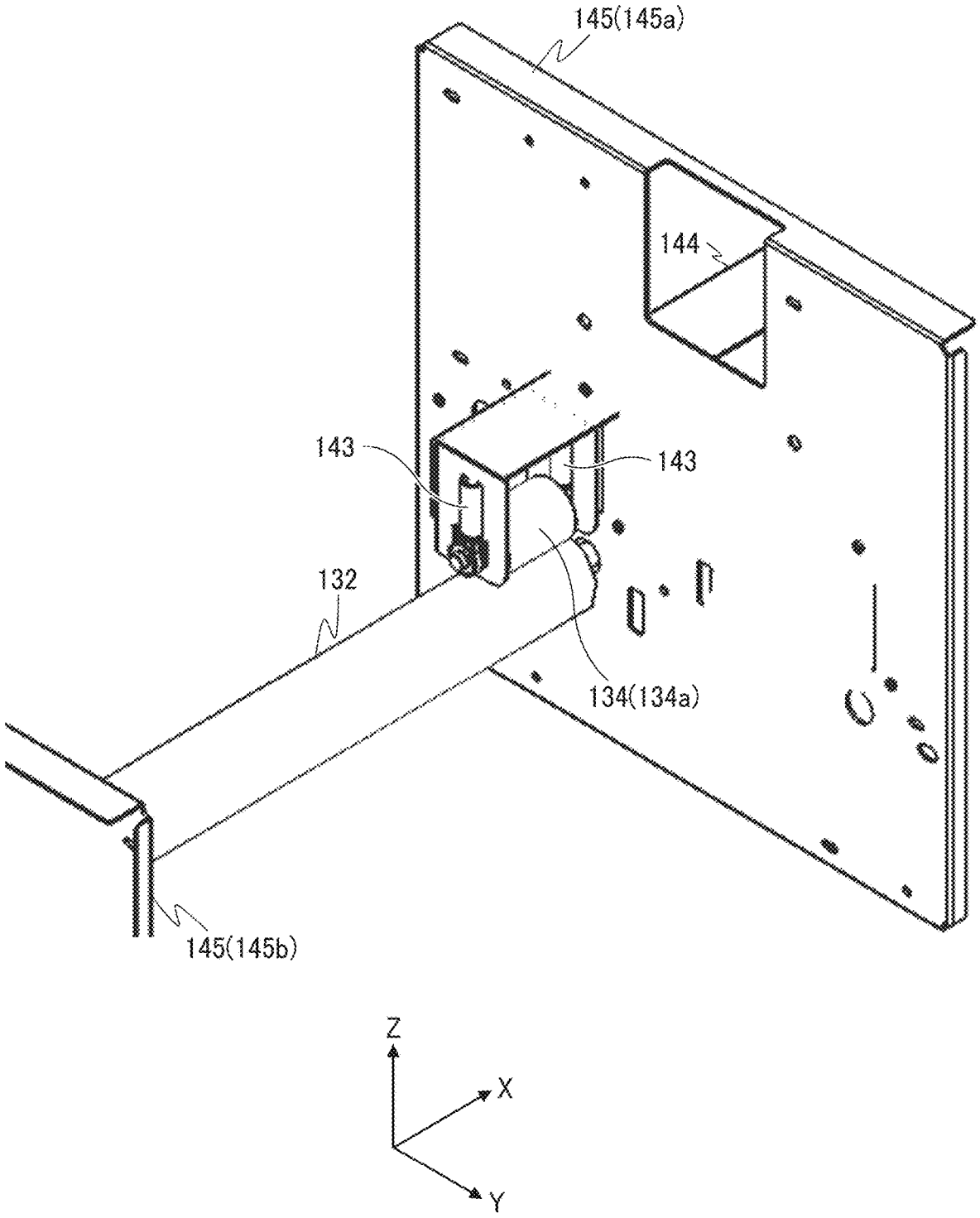
FIG. 11 is an enlarged perspective view illustrating a part of the main part of the sheet processing apparatus.
Figure 12:
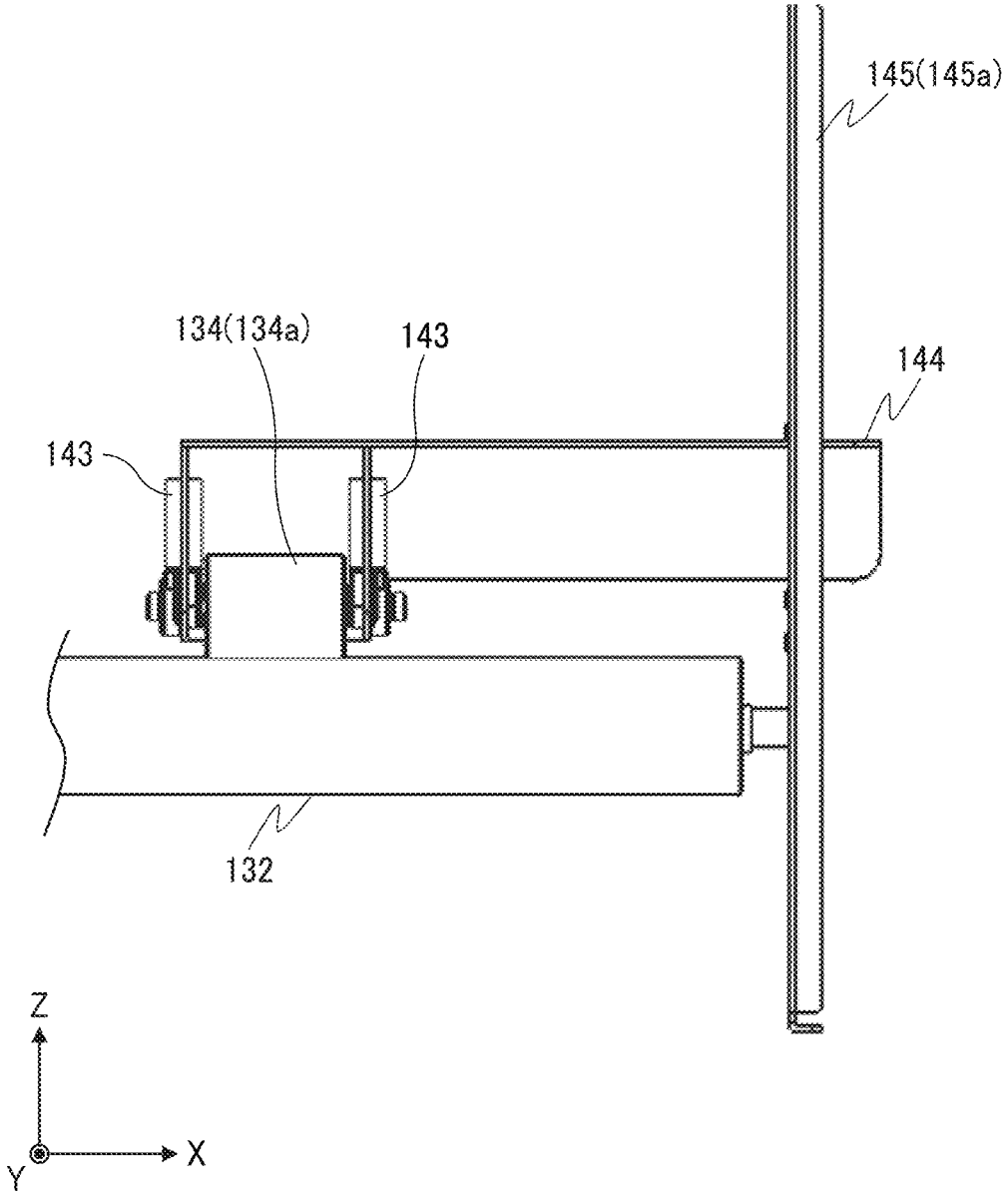
FIG. 12 is a side view illustrating a part of the main part of the sheet processing apparatus.
Figure 13:
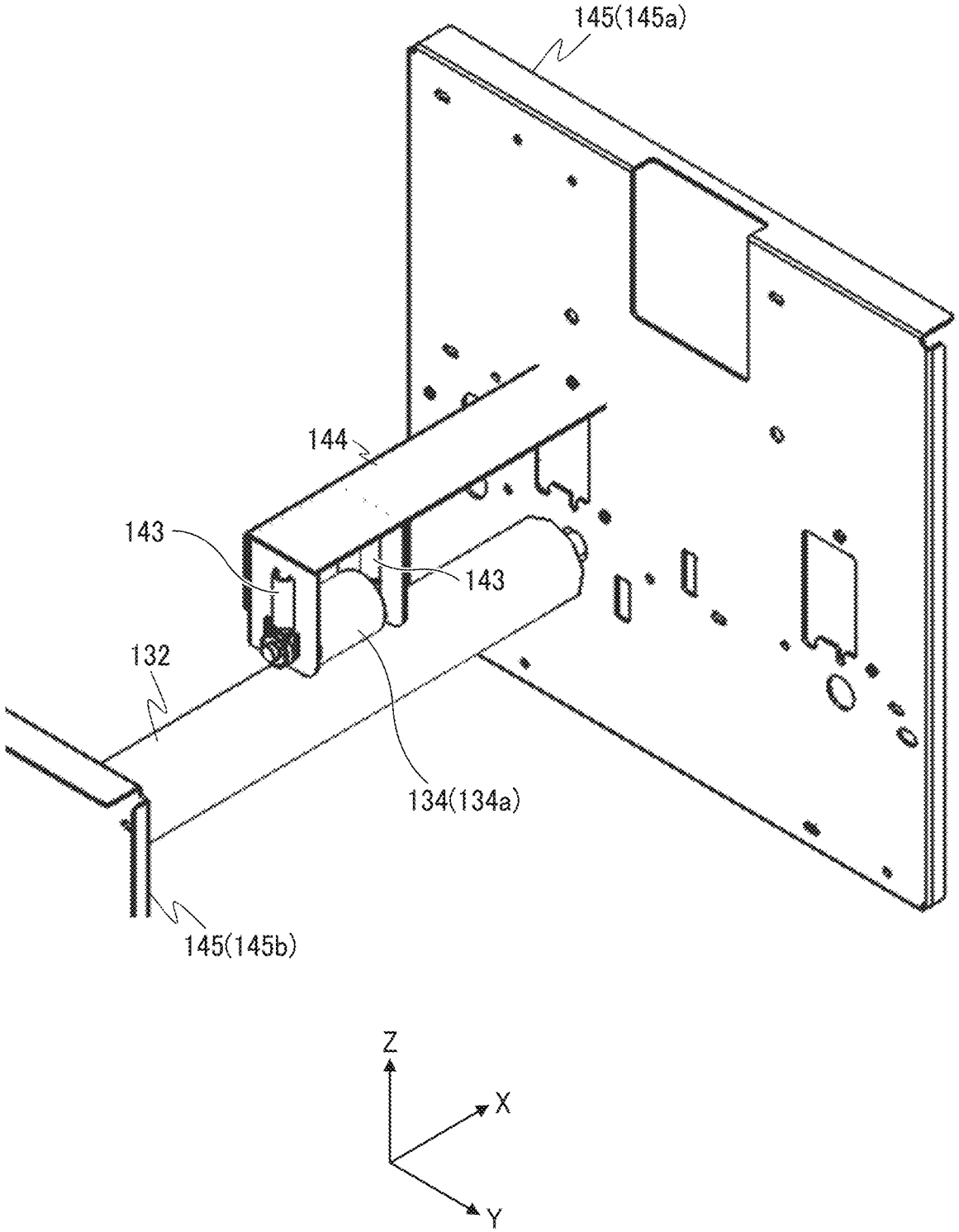
FIG. 13 is an enlarged perspective view illustrating a part of the main part of the sheet processing apparatus.

FIG. 8 is a perspective view illustrating a part of the main part of the sheet processing apparatus 100. FIG. 9 is an enlarged perspective view illustrating a part of the main part of the sheet processing apparatus 100. FIG. 10 is a side view illustrating a part of the main part of the sheet processing apparatus 100. FIG. 11 is an enlarged perspective view illustrating a part of the main part of the sheet processing apparatus 100. FIG. 12 is a side view illustrating a part of the main part of the sheet processing apparatus 100. FIG. 13 is an enlarged perspective view illustrating a part of the main part of the sheet processing apparatus 100.

As illustrated in FIG. 8, the tool facing device 130 is provided with a drive system having components including a Y-axis drive motor 135, a Y-axis output timing pulley 136, a first Y-axis timing belt 137, a Y-axis reduction timing pulley 138, an opposing elastic roller rotary pulley 139, a first Y-axis coupling drive pulley 140, a second Y-axis timing belt 141, and a second Y-axis coupling drive pulley 142.

The Y-axis drive motor 135 is a driving source of the drive system of the tool facing device 130. The Y-axis drive motor 135 is coupled with the Y-axis reduction timing pulley 138 from the Y-axis output timing pulley 136 via the first Y-axis timing belt 137.

The Y-axis reduction timing pulley 138 rotates the opposing elastic roller rotary pulley 139 via a gear portion that is molded as a single component with the Y-axis reduction timing pulley 138. The opposing elastic roller rotary pulley 139 is fixed to one end portion of the rotary shaft of the second facing roller 132.

The first Y-axis coupling drive pulley 140 is fixed to the opposite end portion of the rotary shaft of the second facing roller 132. Further, one end portion of the rotary shaft of the first facing roller 131 is rotatably supported by the housing of the sheet processing apparatus 100. The second Y-axis coupling drive pulley 142 is fixed to the opposite end portion of the rotary shaft of the first facing roller 131. The second Y-axis timing belt 141 is wound around the first Y-axis coupling drive pulley 140 and the second Y-axis coupling drive pulley 142.

As the Y-axis drive motor 135 drives, the one end portion of the rotary shaft of the second facing roller 132 rotates. Then, the first Y-axis coupling drive pulley 140 that is fixed to the opposite end portion of the second facing roller 132 rotates together with the second facing roller 132.

Consequently, the second Y-axis coupling drive pulley 142 that makes a pair with the first Y-axis coupling drive pulley 140 rotates since the second Y-axis coupling drive pulley 142 is coupled with the first Y-axis coupling drive pulley 140 via the second Y-axis timing belt 141. Then, the first facing roller 131 is rotated along with rotation of the second Y-axis coupling drive pulley 142.

With this configuration, in the tool facing device 130, the second facing roller 132 and the first facing roller 131 rotates depending on whether the Y-axis drive motor 135 rotates in the forward direction or the reverse rotation. The second gripping rollers 134 that contact the second facing roller 132 at the respective grip positions are rotated along with rotation of the second facing roller 132. Similarly, the first gripping rollers 133 that contact the first facing roller 131 at the respective grip positions are rotated along with rotation of the first facing roller 131. As described above, the side end portions of the sheet 1 in the width direction of the sheet 1 are gripped by the second facing roller 132 and the second gripping rollers 134 and by the first facing roller 131 and the first gripping rollers 133. The sheet 1 is then reciprocally moved (conveyed) in the Y direction based on the rotational direction of the Y-axis drive motor 135.

As illustrated in FIG. 9, the second gripping roller 134 (that is, the second gripping roller 134*a*) is supported by a gripping roller stay 144 at a given position. The gripping roller stay 144 is supported by the housing of the sheet processing apparatus 100. The gripping roller stay 144 includes two ribs. The ribs are extended downward in the vertical direction from the arm portion of the gripping roller stay 144 in the Z direction and disposed apart at intervals in the X direction. A bearing hole is formed in each of the two ribs and functions as a bearing to receive the rotary shaft of the second gripping roller 134 (i.e., the second gripping roller 134*a*). Further, the gripping roller stay 144 further includes elastic bodies 143 that function as biasing members. The elastic bodies 143 bias both axial ends of the rotary shaft of the second gripping roller 134 (i.e., the second gripping roller 134*a*) protruding from the bearing holes, in the Z direction.

Note that the second gripping roller 134*b* is supported by another gripping roller stay 144 at a given position on the opposite axial end portion of the second facing roller 132. Since the gripping roller stay 144 that supports the second gripping roller 134*b* has the identical structure to the gripping roller stay 144 that supports the second gripping roller 134*a*, the gripping roller stay 144 may be referred to in a singular form, for convenience, particularly when explaining the structure and function.

The elastic bodies 143 are, for example, coil springs, and press the rotary shaft of the second gripping roller 134 (i.e., the second gripping roller 134*a*) in the Z direction that is a direction to separate from the gripping roller stay 144. The second gripping roller 134 (i.e., the second gripping roller 134*a*) is rotatably supported by the gripping roller stay 144 in the X direction that is the axial direction of the rotary shaft of the second facing roller 132 and is biased by the elastic bodies 143 in the Z direction.

The second gripping roller 134 that is biased by the elastic bodies 143 is pressed toward the outer circumferential surface of the second facing roller 132. Due to the pressing force applied toward the second facing roller 132, the second facing roller 132 and the second gripping rollers 134 obtain a gripping force to grip the side end portions of the sheet 1.

In addition to FIGS. 8 to 13, FIGS. 14A and 14B are enlarged perspective views illustrating a part of the main part of the sheet processing apparatus 100.

As illustrated in FIGS. 10 to 14B, the gripping roller stays 144 are slidably retained by a case 145 (that is, cases 145*a* and 145*b*) that constructs the housing of the sheet processing apparatus 100. The control device 300 controls the driving of a stay drive source to slide the gripping roller stay 144 in the X direction, thereby determining the position of the gripping roller stay 144 on the case 145.

The second facing roller 132 is supported by the case 145 such that the rotary shaft of the second facing roller 132 is rotatable. Therefore, the case 145 regulates the positions of the second facing roller 132 in the X direction and the Y direction. On the other hand, since the gripping roller stay 144 is slidable in the X direction alone with respect to the case 145, the gripping roller stay 144 is movable in the X direction with respect to the axial direction (the X direction) of the second facing roller 132 while the second facing roller 132 is supported not to move in the X direction. Therefore, the second gripping rollers 134 (i.e., the second gripping roller 134*a* and the second gripping roller 134*b*) that are supported by the gripping roller stays 144 are also movable in the X direction with respect to the second facing roller 132.

Figure 14A:
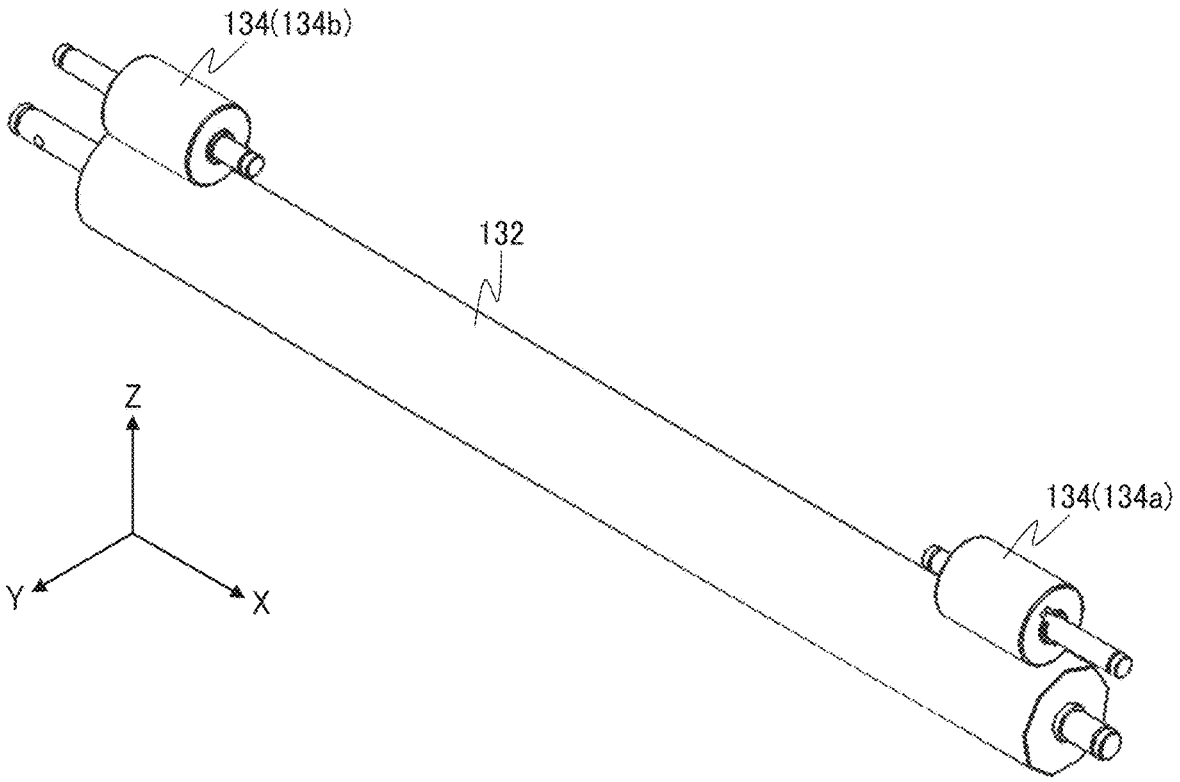
FIGS. 14A and 14B are enlarged perspective views illustrating a part of the main part of the sheet processing apparatus.

For example, as illustrated in FIGS. 10, 11, and 14A, in a case in which the sheet 1 is gripped in a state in which the second gripping rollers 134 are moved near the longitudinal end portions of the second facing roller 132, sheet processing may be performed to the sheet 1 over an area having the width of the sheet 1 that is substantially same as the length of the second facing roller 132.

Figure 14B:
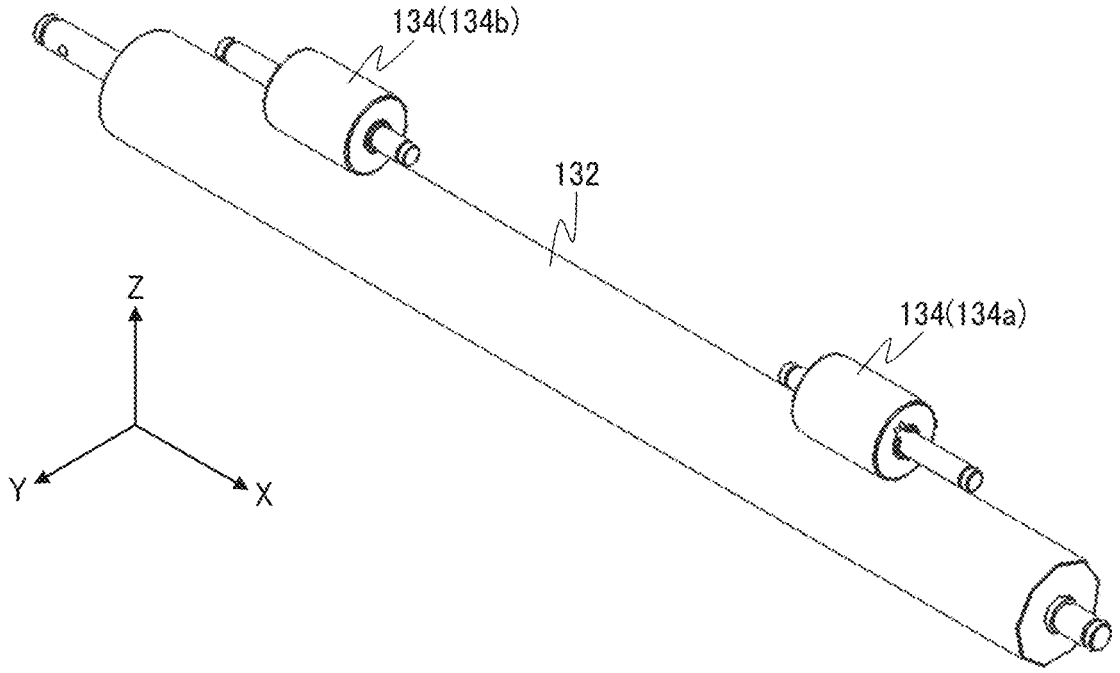

Further, as illustrated in FIGS. 12, 13, and 14B, in a case in which the sheet 1 is gripped in a state in which the second gripping rollers 134 are moved from the vicinity of the longitudinal end portions of the second facing roller 132 to the center of the second facing roller 132, sheet processing may be performed to the sheet 1 having the width narrower (smaller) than the length of the second facing roller 132.

As described above, the sheet processing apparatus 100 includes a grip position changer to change the position of the second gripping roller 134 along the axial direction of the rotary shaft of the second facing roller 132. The grip position changer moves the first gripping roller 133 (i.e., the first gripping roller 133*a*) and the second gripping roller 134 (i.e., the second gripping roller 134*a*), both of which function as gripping portions, in the direction (the X direction) intersecting the conveyance direction of the sheet 1 (the Y direction). That is, since the grip positions at which the sheet 1 is gripped are changed along the axial direction of the second facing roller 132, the grip positions are changed according to the width of the sheet 1. The control device 300, which is described below, controls the positions of the gripping roller stays 144 in the X direction based on the size setting of the sheet 1 performed by a user. By so doing, accurate sheet processing is performed to the sheet 1 based on a given sheet size. In addition, the control device 300, which is described below, controls the positions of the gripping roller stays 144 in the X direction, using the output result based on the position of the side end portion of the sheet 1 detected by a sheet sensor that is disposed near the sheet receiving port of the sheet processing apparatus 100. By so doing, the grip position is automatically set according to the size of the sheet 1 that is a process target object, thereby performing accurate sheet processing to the sheet 1. The gripping roller stay 144 constructs the grip position changer.

Note that the configuration of the adjustment mechanism of the grip position in connection to the second facing roller 132 was described above. However, in the sheet processing apparatus 100, the adjustment mechanism of the grip position in connection to the first facing roller 131 has the same configuration.

Another Embodiment of Tool Facing Member.

Figure 15:
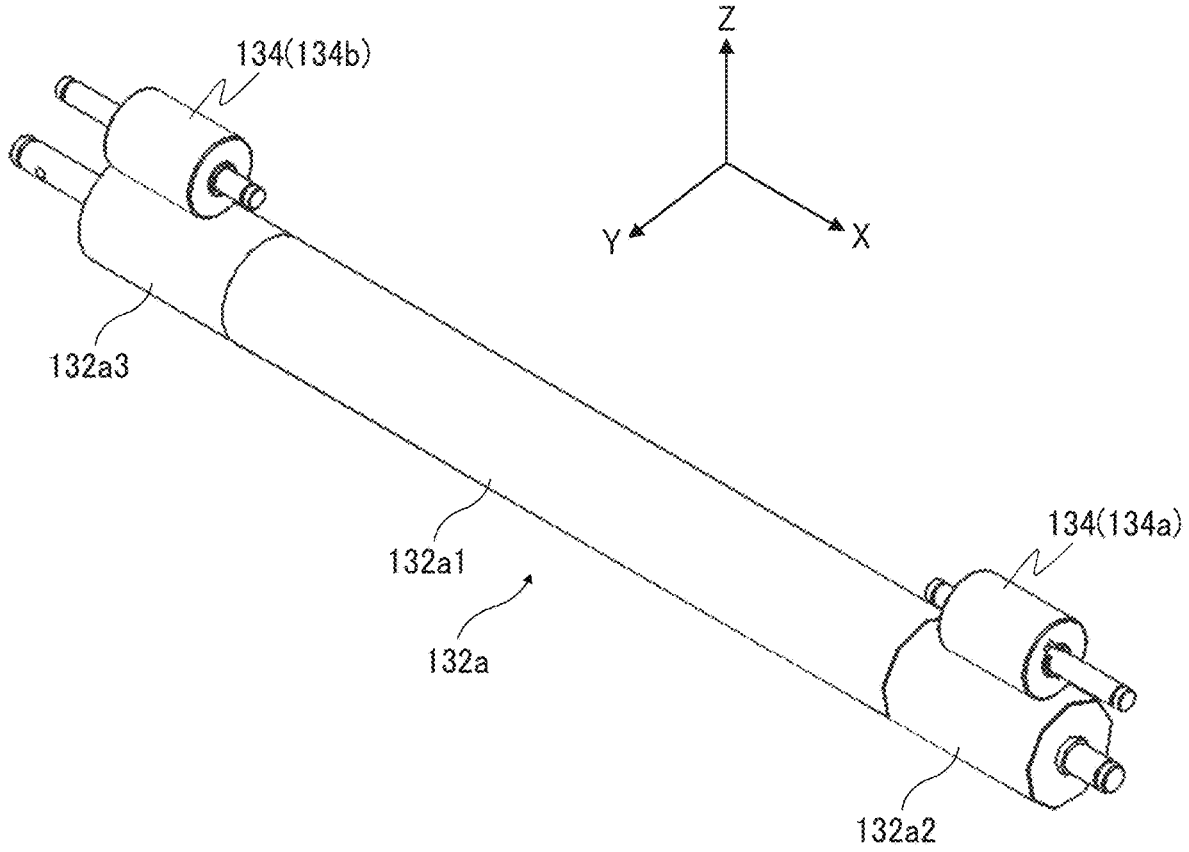
FIG. 15 is an enlarged perspective view illustrating a part of the main part of the sheet processing apparatus.

Next, a description is given of another embodiment of the second facing roller 132 according to the present embodiment, with reference to FIG. 15.

FIG. 15 is an enlarged perspective view illustrating a part of the main part of the sheet processing apparatus 100.

The second facing roller 132*a* illustrated in FIG. 15 includes an elastic function as an opposing face to the processing tools 105 and a conveyance function of the sheet 1. The second facing roller 132*a* in FIG. 15 is divided into a plurality of portions, in this case, three portions along the axial direction. The three portions of the second facing roller 132 rotate together as a single component.

The axial center portion of the second facing roller 132*a* is a tool facing part 132*a*1 including the opposing face to face the creasing tool 112. Further, the end portions in the axial direction are grip parts 132*a*2 and 132*a*3 to grip the sheet 1 with the second gripping rollers 134 (that is, the second gripping roller 134*a* and the second gripping roller 134*b*). In other words, the tool facing part 132*a*1 and the grip parts 132*a*2 and 132*a*3 have different surface shapes in the direction intersecting the conveyance direction of the sheet 1.

It is preferable that the tool facing part 132*a*1 has rigidity appropriate to the crease process when the sheet 1 is pressed by the creasing tool 112. For example, it is preferable that the tool facing part 132*a*1 is made of polyurethane material and has the rigidity of 50 degrees, for example.

Further, since the grip parts 132*a*2 and 132*a*3 are portions to pair with the second gripping rollers 134 (that is, the second gripping roller 134*a* and the second gripping roller 134*b*) and also are portions to grip the side end portions of the sheet 1, it is preferable that the grip parts 132*a*2 and 132*a*3 have rigidity appropriate to holding and conveyance of the sheet 1. For example, it is preferable that the grip parts 132*a*2 and 132*a*3 are made of foamed rubber material and have the rigidity of 80 degrees.

Further, in the second facing roller 132*a* that is divided into the plurality of portions (three portions, in this case), the shape of the surface of the tool facing part 132*a*1 that is a center portion in the axial direction of the second facing roller 132 may be different from the shape of the surfaces of the grip parts 132*a*2 and 132*a*3 that grip the sheet 1 with the second gripping rollers 134 (that is, the second gripping roller 134*a* and the second gripping roller 134*b*). In other words, the tool facing part 132*a*1 and the grip parts 132*a*2 and 132*a*3 have different surface shapes in the direction intersecting the conveyance direction of the sheet 1.

For example, the tool facing part 132*a*1 may use polyurethane material to be appropriate for the crease process to the sheet 1 performed by the creasing tool 112, so that the surface of the tool facing part 132*a*1 is polished to have a "surface roughness Rz of 50 degrees."

Further, the grip parts 132*a*2 and 132*a*3 may use material to be appropriate for holding and conveyance of the sheet 1, so that the surfaces of the grip parts 132*a*2 and 132*a*3 are polished to have a "surface roughness Rz of 80 degrees."

Control Configuration of Sheet Processing Apparatus 100.

Figure 16:
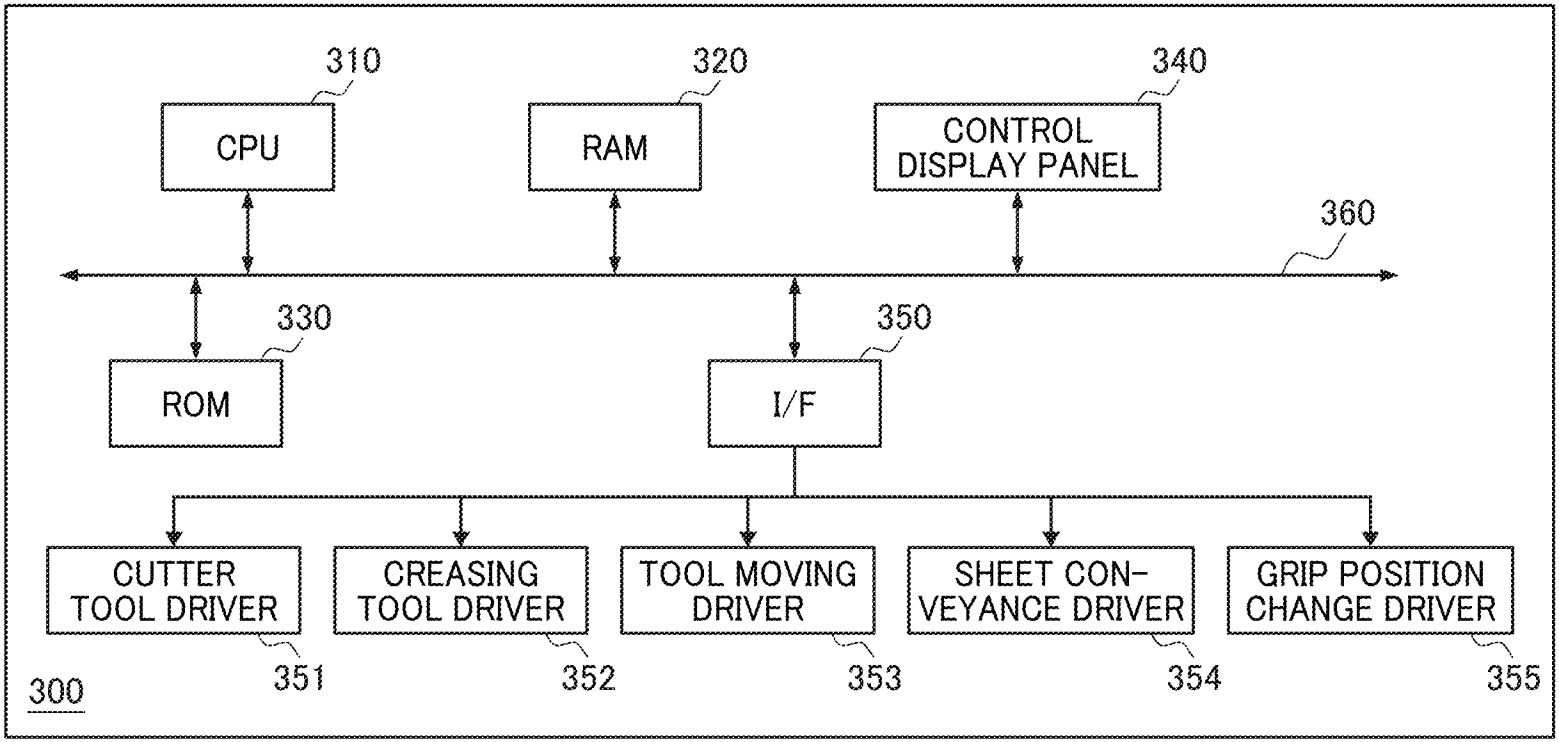
FIG. 16 is a block diagram illustrating a hardware configuration of a drive system of the sheet processing apparatus.
Figure 17:
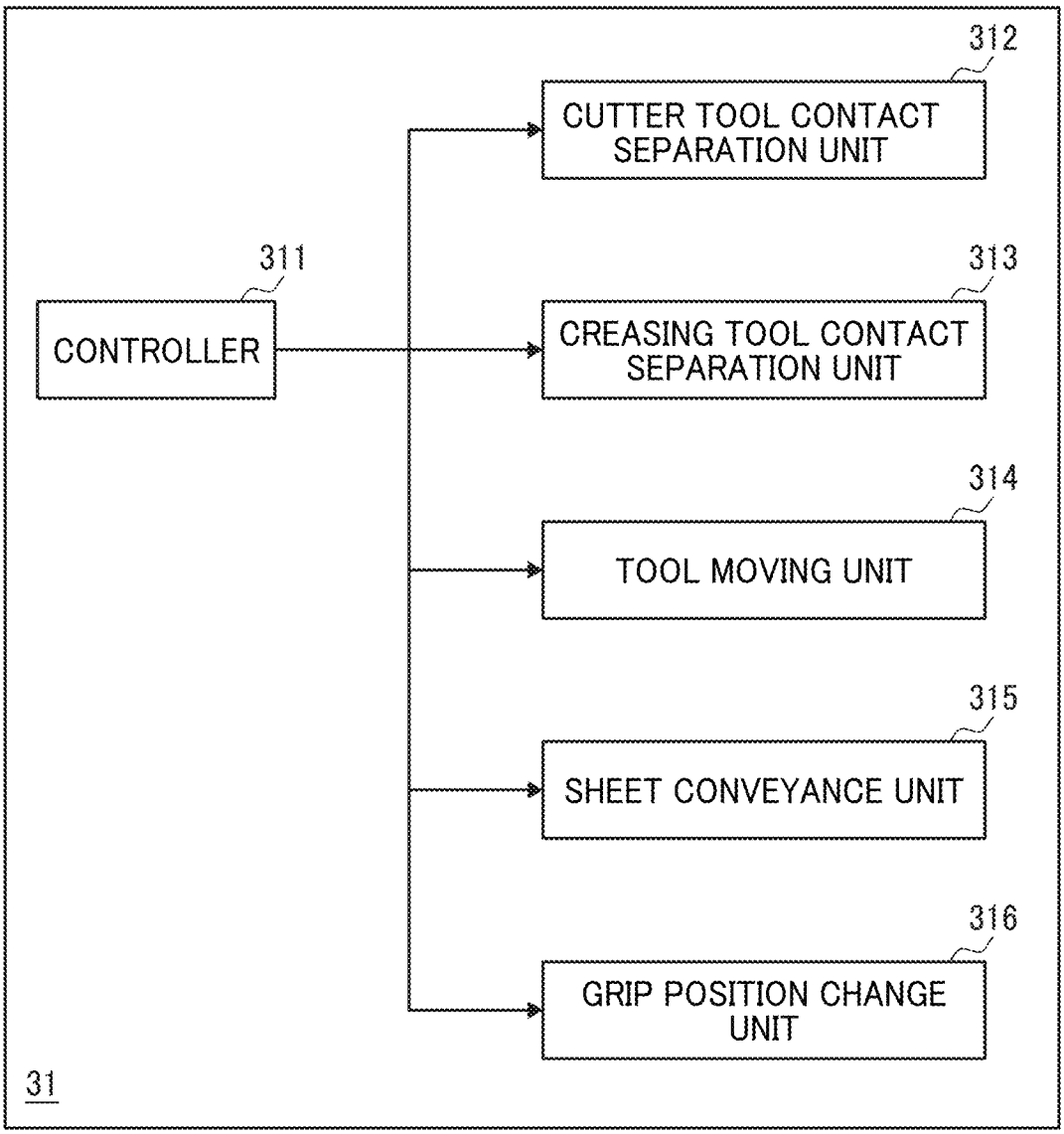
FIG. 17 is a functional block diagram illustrating a functional configuration of the drive system of the sheet processing apparatus.

Next, a description is given of the control configuration of the control device 300 that is the control system of the sheet processing apparatus 100 according to the present embodiment of this disclosure, with reference to FIGS. 16 and 17.

FIG. 16 is a block diagram illustrating a hardware configuration of the control device 300 that is the control system of the sheet processing apparatus 100. FIG. 17 is a block diagram illustrating a functional configuration of the control device 300 that is the control system of the sheet processing apparatus 100.

As illustrated in FIG. 16, the sheet processing apparatus 100 includes the control device 300. The control device 300 has the same configuration as generally known information processing devices. That is, in the control device 300 according to the present embodiment of this disclosure, a central processing unit (CPU) 310, a random access memory (RAM) 320, a read only memory (ROM) 330, a control display panel 340, and an interface (I/F) 350 are connected via a bus 360. A cutter tool driver 351, a creasing tool driver 352, a tool moving driver 353, a sheet conveyance driver 354, and a grip position change driver 355 are connected to the IN 350.

The CPU 310 is a calculation unit and controls the operation of the entire information processing device. The RAM 320 is a volatile memory capable of high-speed reading and writing of information. The RAM 320 is used as a work area when the CPU 310 processes information. The ROM 330 is a read-only non-volatile memory to store firmware, control programs, and the like. The control display panel 340 is provided with a display screen that displays information to notify a user of the operation status of the sheet processing apparatus 100, for example. The control display panel 340 also provides an input interface via which a user inputs a set value to be used for the control. For example, a user may operate the control display panel 340 to set the sheet size of the sheet 1.

The I/F 350 transmits a control signal generated as a result of calculation of the CPU 310, to a specified driver, so that the driver causes a corresponding unit to perform each designated function. The cutter tool driver 351 controls the contact and separation operations in which the cutter tool 111 selectively contacts to and separates from the sheet 1. The creasing tool driver 352 controls the contact and separation operations in which the creasing tool 112 selectively contacts to and separates from the sheet 1. The tool moving driver 353 controls rotational movement of the X-axis drive motor 121 in the forward and reverse directions. The sheet conveyance driver 354 controls respective rotational operations of the first facing roller 131 and the second facing roller 132 and rotational operations of the pairs of sheet conveyance rollers 150. The grip position change driver 355 changes the positions of the first gripping roller 133 and the second gripping roller 134 in the X direction, so as to perform a changing operation to change the grip positions.

Functional Configuration of Sheet Processing Apparatus 100.

In the hardware configuration described above, the CPU 310 performs calculation according to the program stored in the ROM 330, thereby constructing a software controller. A combination of the software controller thus constructed and the hardware constructs functional blocks that implement functions of the sheet processing apparatus 100 according to the present embodiment is formed (see FIG. 17).

As illustrated in FIG. 17, a control unit 31 is achieved by the control device 300 of the sheet processing apparatus 100 and includes a controller 311 that controls the whole operations of the sheet processing apparatus 100, a cutter tool contact separation unit 312, a creasing tool contact separation unit 313, a tool moving unit 314, a sheet conveyance unit 315, and a grip position change unit 316.

The cutter tool contact separation unit 312 causes the cutter tool 111 to contact, press, or separate from the sheet 1 at a given timing.

The creasing tool contact separation unit 313 causes the creasing tool 112 to contact, press, or separate from the sheet 1 at a given timing.

The tool moving unit 314 controls the tool contact separation device 110 along the X-axis (the X direction), specifically, the moving direction, the moving amount, the moving speed, and timings of start and stop of movements of the tool contact separation device 110 along the X-axis (the X direction).

The sheet conveyance unit 315 controls the sheet 1 along the Y-axis (the Y direction), specifically, the moving direction (the conveyance direction), the moving amount, the moving speed, and timings of start and stop of movements of the sheet 1 along the Y-axis (the direction).

The grip position change unit 316 causes the gripping roller stay 144 to slide on the cases 145 (that is, the cases 145*a* and 145*b*), so as to change the positions of the first gripping rollers 133 to the first facing roller 131 and the positions of the second gripping rollers 134 to the second facing roller 132. The positions of the first gripping rollers 133 and the positions of the second gripping rollers 134 are determined based on the size of the sheet 1.

Due to the determination, when the cutter tool 111 performs the cut process to the sheet 1 and the creasing tool 112 performs the crease process to the sheet 1, the sheet 1 is gripped at both side end portions of the sheet 1 in the width direction of the sheet 1 at the same positions as the process positions in the conveyance direction of the sheet 1. By gripping as described above, the process positions of the sheet 1 may be stabilized, thereby performing accurate sheet processing to the sheet 1.

Note that, in the sheet processing apparatus 100 according to the present embodiment, the end portions in the width direction of the sheet 1 are gripped separately at the same positions as the positions in the conveyance direction of the plurality of processing tools 105 (i.e., the cutter tool 111 and the creasing tool 112). Accordingly, when the plurality of processing tools 105 perform the sheet processing to the sheet 1, the position of the sheet 1 is more stabilized.

The control unit 31 including a control program executed by the CPU 310 configures the above-described function units, so that the function units execute the control operations. By performing these control operations, the cutter tool 111 and the creasing tool 112 are moved while conveying the sheet 1, so as to selectively perform the contact and separation operations. By performing the contact and separation operations, while a given trajectory in the two-dimensional area is drawn on the sheet 1, the crease process is performed to the sheet 1 at a desired position or positions and the cut process is performed to cut the sheet 1 to a desired shape.

Further, the grip position change unit 316 determines the size of the sheet 1 by a value set by a user via the control display panel 340 (the value is temporarily stored in the RAM 320) or by a value calculated based on the output value detected by the sheet sensor disposed near the sheet receiving port. The gripping roller stay 144 moves based on the thus determined size of the sheet 1. Then, the positions of the first gripping rollers 133 to the first facing roller 131 and the positions of the second gripping rollers 134 to the second facing roller 132 in the X direction are changed according to the size of the sheet 1. Accordingly, the grip positions of the sheet 1 are changed.

When the sheet processing apparatus 100 performs the sheet processing in the direction orthogonal to (intersecting) the conveyance direction of the sheet 1 after the change of the grip positions of the sheet 1 (the first processing), the first facing roller 131 and the second facing roller 132 are held not to rotate. On the other hand, when the sheet processing apparatus 100 performs the sheet processing in a direction other than the direction orthogonal to (intersecting) the conveyance direction of the sheet 1 (the second processing), the first facing roller 131 and the second facing roller 132 rotate in the conveyance direction of the sheet 1 to move together with the sheet 1. By controlling the operation as described above, the position of the sheet 1 is stabilized when the sheet processing is performed to the sheet 1 and the relative movements of the first facing roller 131 and the second facing roller 132 to the sheet 1 are brought to be a state appropriate to the first processing and a state appropriate to the second processing.

Embodiment of Image Forming System.

Figure 18:
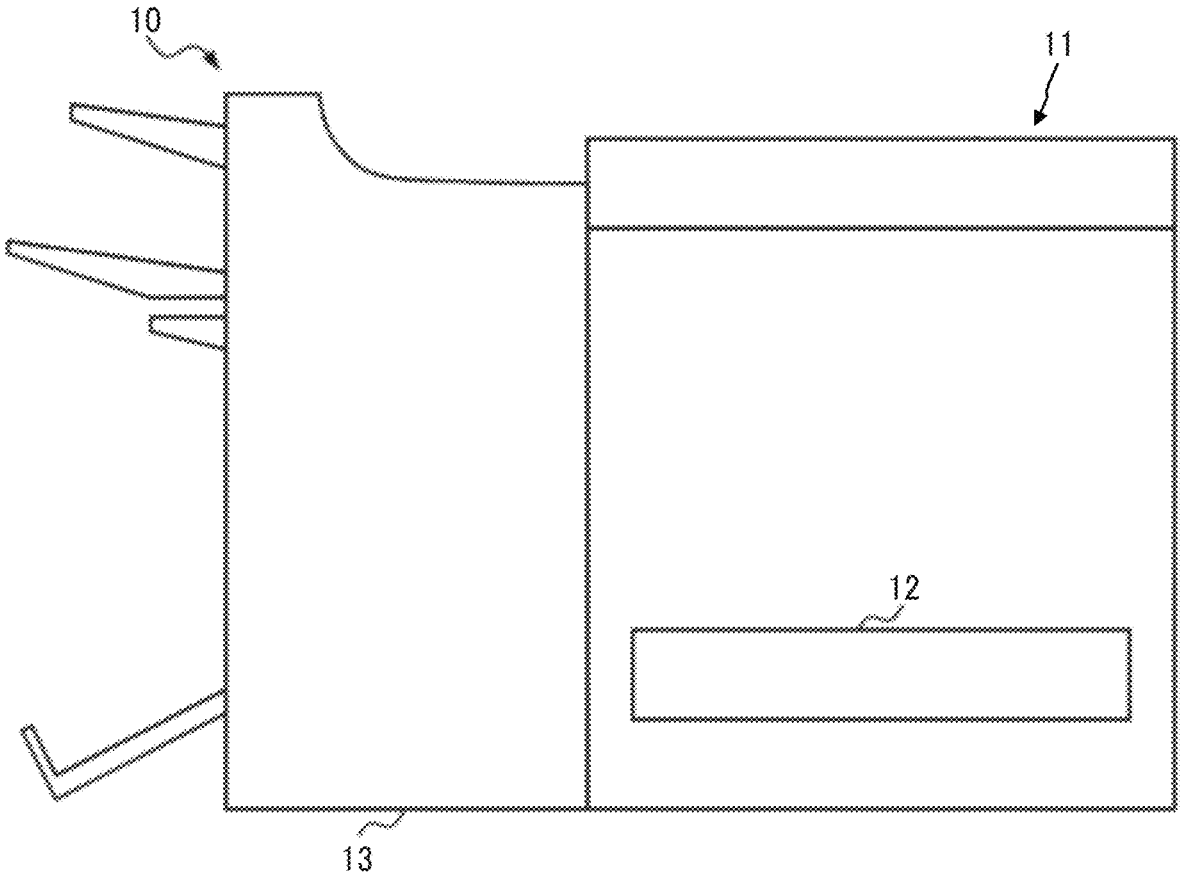
FIG. 18 is a side view illustrating an image forming system according to an embodiment of this disclosure.

Next, a description is given of an image forming system according to an embodiment of this disclosure, with reference to FIG. 18.

FIG. 18 is a side view illustrating the external appearance of an image forming system 10 according to an embodiment of this disclosure.

The sheet processing apparatus 100 described above is applicable as a stand-alone apparatus but may be included in the image forming system 10.

The image forming system 10 includes an image forming apparatus 11 and a post-processing device 13. The image forming apparatus 11 includes a media feeding device 12.

The image forming apparatus 11 forms a given image on a sheet 1 fed from the media feeding device 12 and conveys the sheet 1 toward the post-processing device 13. Note that the image forming apparatus 11 is an apparatus that attaches material (such as liquid ink and toner) to form an image onto the sheet 1 that functions as a recording medium and that relates to, for example, electrophotographic printing, inkjet printing, and screen printing.

In a case in which the sheet processing apparatus 100 is provided in the post-processing device 13, after the image forming apparatus 11 forms an image on the sheet 1, the sheet processing apparatus 100 performs the first processing and the second processing, as described above, to convey the processed sheet 1.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure, and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a sheet conveyor configured to convey a sheet;

a processing tool configured to perform processing to the sheet;

a tool contact separation device configured to contact and separate the processing tool with respect to the sheet;

a tool moving device configured to move the processing tool in a direction intersecting a conveyance direction of the sheet;

a tool facing portion, including a rotary member supported by a shaft, disposed at a position facing the processing tool via the sheet; and a sheet gripper, including a rotary member supported by a shaft, configured to grip the sheet with the tool facing portion at a position relatively closer to an edge of the sheet than the position at which the tool facing portion faces the processing tool.

2. The sheet processing apparatus of claim 1, wherein the sheet gripper is disposed out of a processing region in which the processing tool is configured to perform the processing to the sheet.

3. The sheet processing apparatus of claim 1, further comprising:

a plurality of processing tools, including the processing tool, disposed in the conveyance direction of the sheet;

a plurality of tool facing portions, including the tool facing portion, provided corresponding to the plurality of processing tools; and a plurality of sheet grippers, including the sheet gripper, provided corresponding to the plurality of processing tools.

4. The sheet processing apparatus of claim 3, wherein the plurality of tool facing portions each include:

a first facing portion disposed downstream in the conveyance direction of the sheet; and a second facing portion disposed upstream from the first facing portion in the conveyance direction of the sheet, and wherein the tool contact separation device or the tool moving device is disposed facing a portion between the first facing portion and the second facing portion.

5. The sheet processing apparatus of claim 1, wherein the tool facing portion and the sheet gripper are configured to grip the sheet across at least one end portion of the sheet in the direction intersecting the conveyance direction of the sheet.

6. The sheet processing apparatus of claim 1, wherein the tool facing portion includes an elastic body.

7. The sheet processing apparatus of claim 1, wherein the tool facing portion includes a plurality of portions, including different surface shapes in the direction intersecting the conveyance direction of the sheet.

8. An image forming system, comprising:

an image forming apparatus, configured to form an image on a sheet and eject the sheet with the image; and the sheet processing apparatus of claim 7, configured to process the sheet with the image formed by the image forming apparatus.

9. An image forming system, comprising:

an image forming apparatus, configured to form an image on a sheet and eject the sheet with the image; and the sheet processing apparatus of claim 1, configured to process the sheet with the image formed by the image forming apparatus.

10. The sheet processing apparatus of claim 1, wherein the processing tool includes at least one of:

a creaser configured to make a crease in a surface of the sheet; and a cutter configured to cut the sheet.

11. The sheet processing apparatus of claim 1, further comprising:

a grip position changer configured to support the sheet gripper and move the sheet gripper toward the tool facing portion in the direction intersecting the conveyance direction of the sheet.

12. A sheet processing apparatus, comprising:

a sheet conveyor configured to convey a sheet;

a processing tool configured to perform processing to the sheet;

a tool contact separation device configured to contact and separate the processing tool with respect to the sheet;

a tool moving device configured to move the processing tool in a direction intersecting a conveyance direction of the sheet;

a tool facing portion, including a rotary member supported by a shaft, disposed at a position facing the processing tool via the sheet;

a sheet gripper, including a rotary member supported by a shaft, configured to grip the sheet with the tool facing portion; and a grip position changer configured to support the sheet gripper and configured to move the sheet gripper toward the tool facing portion in the direction intersecting the conveyance direction of the sheet.

13. An image forming system, comprising:

an image forming apparatus, configured to form an image on a sheet and eject the sheet with the image; and the sheet processing apparatus of claim 12, configured to process the sheet with the image formed by the image forming apparatus.

14. A sheet processing apparatus, comprising:

a sheet conveyor configured to convey a sheet;

a processing tool configured to perform processing to the sheet;

a tool contact separation device configured to contact and separate the processing tool with respect to the sheet;

a tool moving device configured to move the processing tool in a direction intersecting a conveyance direction of the sheet;

a tool facing portion, including a rotary member supported by a shaft, disposed at a position facing the processing tool via the sheet; and a sheet gripper, including a rotary member supported by a shaft, configured to grip the sheet with the tool facing portion, wherein the processing tool includes at least one of:

a creaser configured to make a crease in a surface of the sheet; and a cutter configured to cut the sheet.

15. An image forming system, comprising:

an image forming apparatus, configured to form an image on a sheet and eject the sheet with the image; and the sheet processing apparatus of claim 14, configured to process the sheet with the image formed by the image forming apparatus.

16. The sheet processing apparatus of claim 14, further comprising:

a grip position changer configured to support the sheet gripper and move the sheet gripper toward the tool facing portion in the direction intersecting the conveyance direction of the sheet.

* * * * *